US010899150B2

(12) United States Patent
Eto

(10) Patent No.: US 10,899,150 B2
(45) Date of Patent: Jan. 26, 2021

(54) LIQUID PROCESSING DEVICE

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/576,509

(22) Filed: Sep. 19, 2019

(65) Prior Publication Data

US 2020/0094592 A1 Mar. 26, 2020

(30) Foreign Application Priority Data

Sep. 25, 2018 (JP) ..... 2018-178693

(51) Int. Cl.

| | |
|---|---|
| ***B41J 29/54*** | (2006.01) |
| ***B41J 25/00*** | (2006.01) |
| *B41J 2/175* | (2006.01) |
| *B41J 25/34* | (2006.01) |

(52) U.S. Cl.

CPC ..... *B41J 25/006* (2013.01); *B41J 29/54* (2013.01); *B41J 2/175* (2013.01); *B41J 25/34* (2013.01)

(58) Field of Classification Search

CPC . B41J 25/006; B41J 25/34; B41J 29/54; B41J 2/175

See application file for complete search history.

(56) References Cited

U.S. PATENT DOCUMENTS 6,435,663 B2 * 8/2002 Yamaguchi ..... B41J 2/1752 347/49
6,648,456 B1 * 11/2003 Asano ..... B41J 2/1752 347/49

FOREIGN PATENT DOCUMENTS

JP 2005-1307 A 1/2005

* cited by examiner

*Primary Examiner* — Yaovi M Ameh
(74) *Attorney, Agent, or Firm* — Stein IP, LLC

(57) ABSTRACT

Each of a first pressing member and a second pressing member is rotatable about a predetermined axis so as to be capable of changing its posture between a first posture and a second posture inclined upward at its end from the first posture, and is disposed on the mounting part in a rockable manner in a direction pressing the head unit, so as to press the head unit in the first posture.

6 Claims, 23 Drawing Sheets

LIQUID PROCESSING DEVICE

INCORPORATION BY REFERENCE

This application is based upon and claims the benefit of priority from the corresponding Japanese Patent Application No. 2018-178693 filed Sep. 25, 2018, the entire contents of which are hereby incorporated by reference.

BACKGROUND

The present disclosure relates to a liquid processing device such as an inkjet printer, which performs a predetermined processing by ejecting liquid from a head unit to a work.

For instance, an inkjet printer performs a print processing of ejecting micro amount of ink (liquid) from a head unit to a work such as a sheet or a cloth. Usually, the head unit is mounted on a carriage for print-scan. The work is conveyed in a predetermined conveying direction, while the carriage mounting the head unit reciprocates in a direction perpendicular to the conveying direction, and in this state the head unit ejects ink. In this way, characters or images are formed on the work.

In order to suppress occurrence of printing defect such as unevenness of density or out of color registration of the image formed on the work, it is necessary to accurately position and fix the head unit with respect to the carriage. A technique of a fixing mechanism for fixing the head unit to the carriage in this way is conventionally proposed. For instance, the head unit mounted on the carriage is pressed by a restoring force of a leaf spring, and hence the head unit is positioned and fixed with respect to the carriage.

The operation of mounting the head unit on the carriage is performed by a worker. If the conventional technique is adopted as the fixing mechanism for fixing the head unit to the carriage, in an operation of moving the head unit in the mounting direction with respect to the carriage when mounting the head unit on the carriage, the head unit is moved while receiving a frictional resistance due to the restoring force of the leaf spring. Therefore, if the restoring force of the leaf spring is set to a large value in order to increase a fixing force of the head unit to the carriage, the frictional resistance in the moving operation of the head unit for mounting may increase resulting in bad workability. On the contrary, if the restoring force of the leaf spring is set to a small value in order to improve the workability in the mounting operation of the head unit, the fixing force of the head unit to the carriage is decreased.

SUMMARY

A liquid processing device according to one aspect of the present disclosure includes a head unit, a head holder, and a fixing mechanism. The head unit ejects liquid to a predetermined work. The head holder includes a mounting part on which the head unit is mounted, so as to hold the head unit in a state mounted on the mounting part. The fixing mechanism positions and fixes the head unit moved in a predetermined mounting direction and mounted to the mounting part, with respect to the mounting part. The fixing mechanism includes a first positioning part and a second positioning part. The first positioning part includes a first pressing member and a first position regulation part. The first pressing member presses the head unit mounted on the mounting part in the mounting direction. The first position regulation part regulates position of the head unit pressed by the first pressing member in the mounting direction on the mounting part. The second positioning part includes a second pressing member and a second position regulation part. The second pressing member presses the head unit mounted on the mounting part to one side in a head unit width direction perpendicular to the mounting direction. The second position regulation part regulates position of the head unit pressed by the second pressing member in the width direction on the mounting part. Each of the first pressing member and the second pressing member is rotatable about a predetermined axis so as to be capable of changing its posture between a first posture and a second posture inclined upward at its end from the first posture, and is disposed on the mounting part in a rockable manner in a direction pressing the head unit, so as to press the head unit in the first posture.

Other objects of the present disclosure and specific advantages obtained by the present disclosure will become more apparent from the description of the embodiment given below.

DETAILED DESCRIPTION

[Overall Structure of Image Forming Apparatus]

Figure 1:
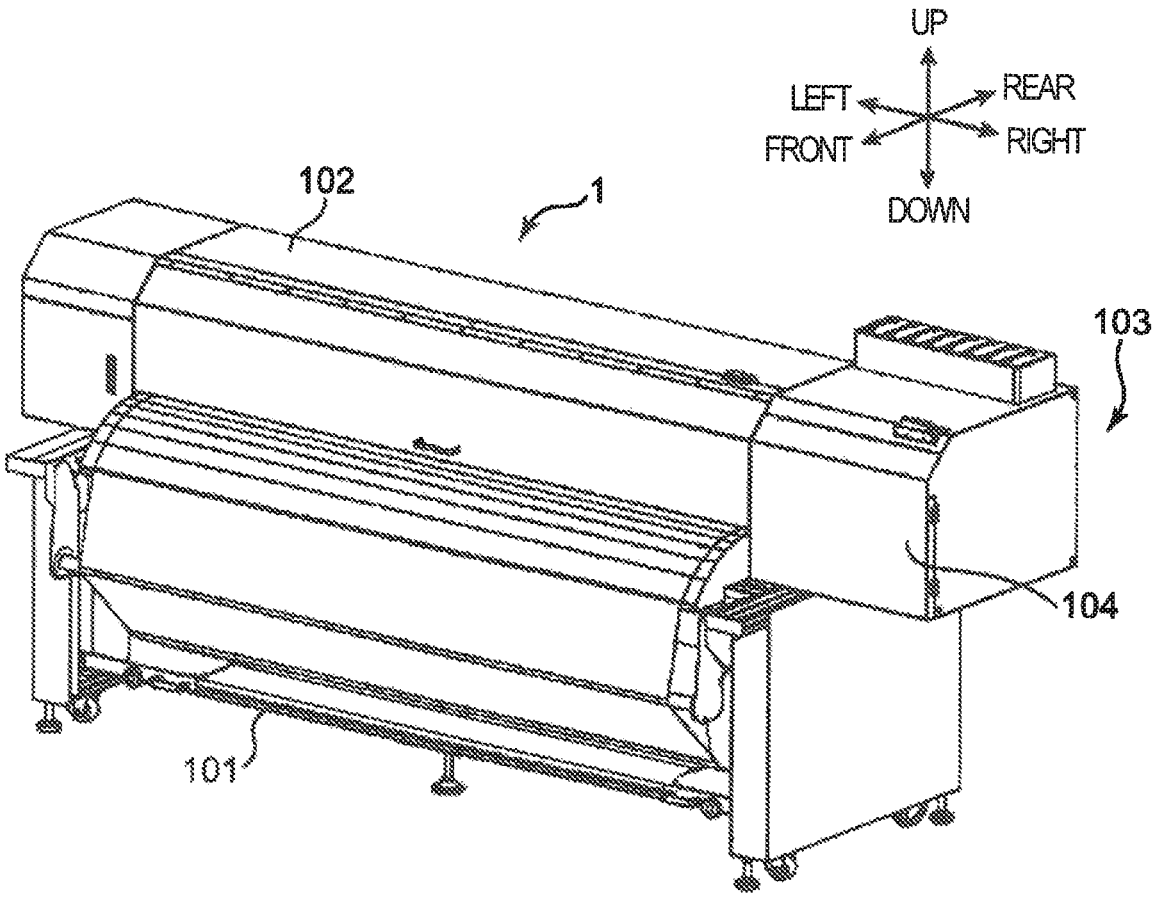
FIG. 1 is a perspective view illustrating an external view of an image forming apparatus according to one embodiment of the present disclosure.
Figure 2:
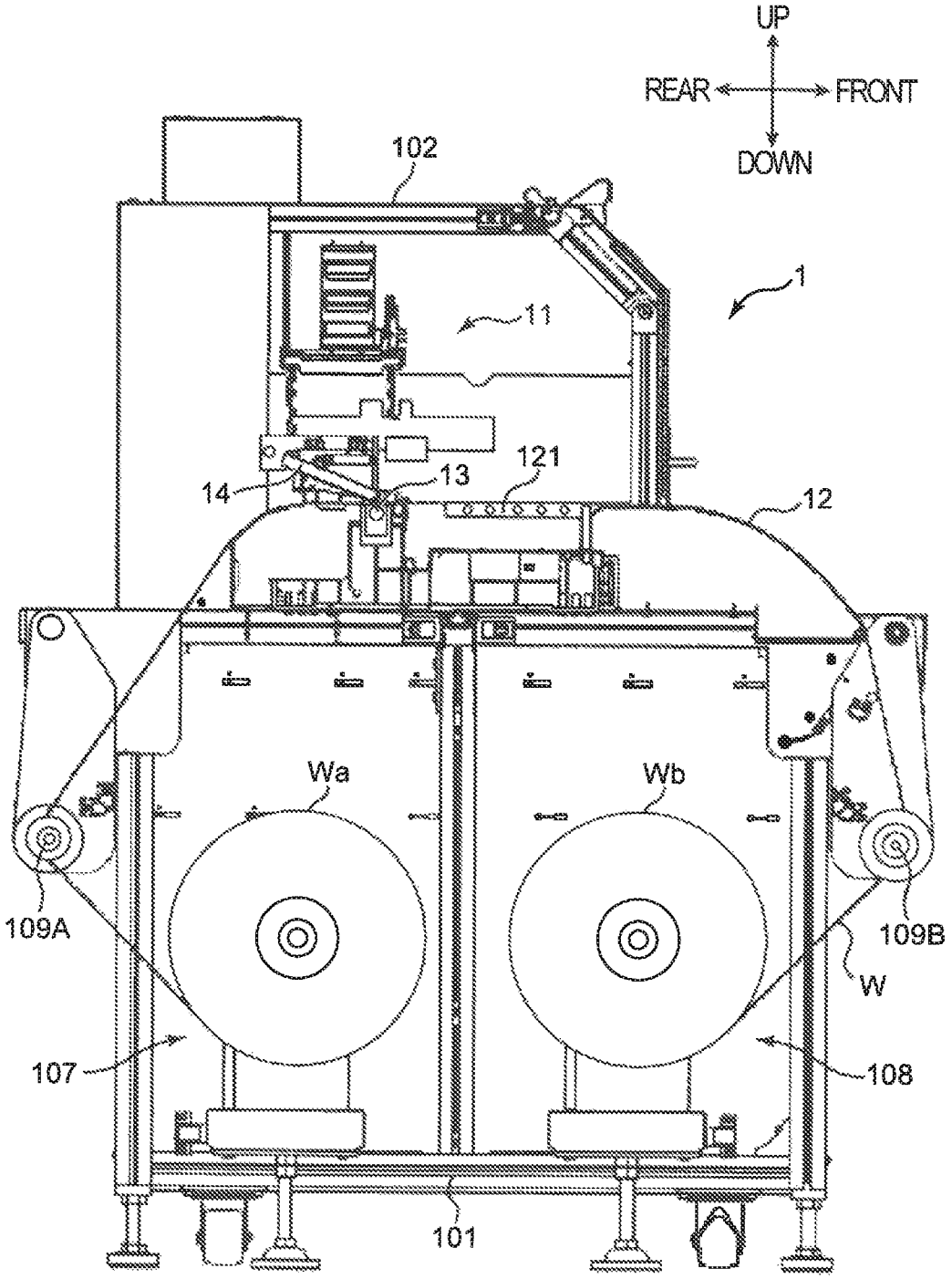
FIG. 2 is a cross-sectional view of the image forming apparatus.
Figure 3:
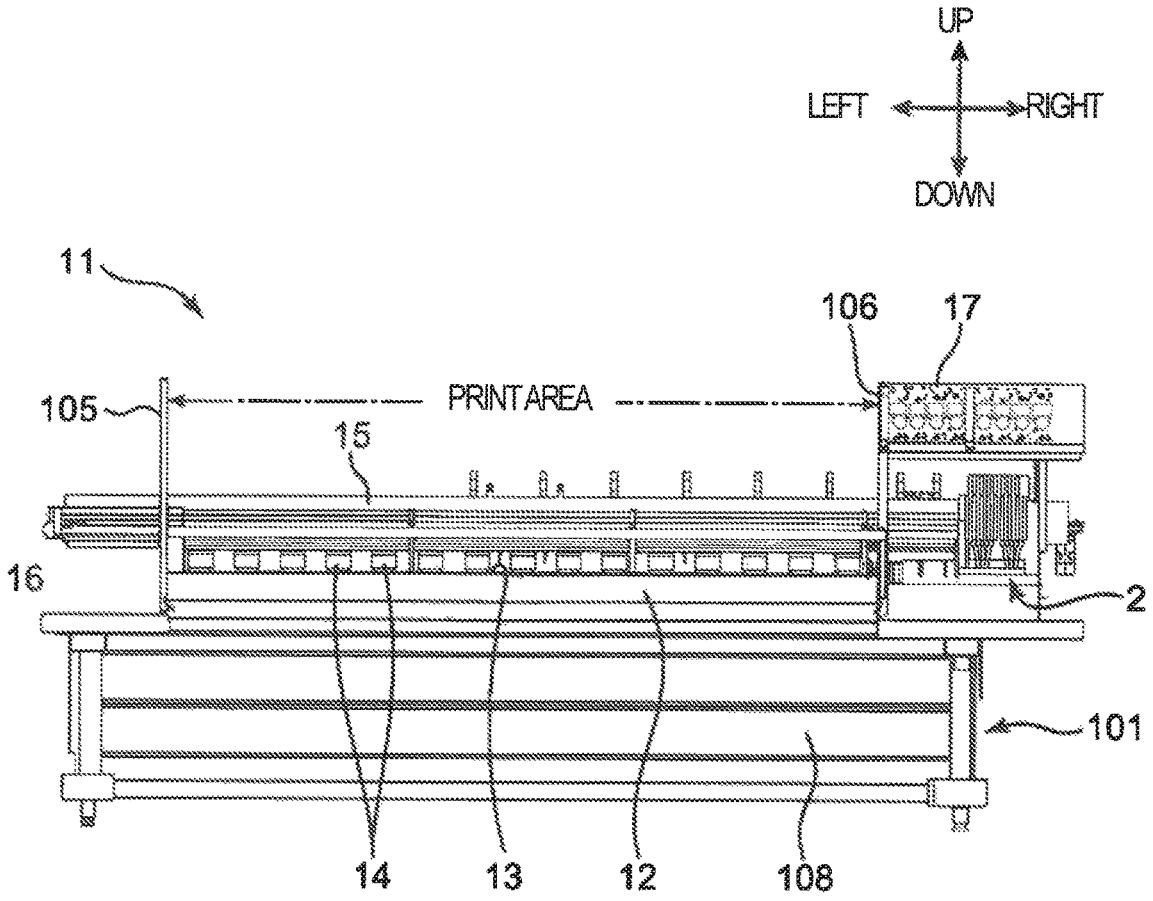
FIG. 3 is a front view of the image forming apparatus in a state where an outer cover is removed.
Figure 4:
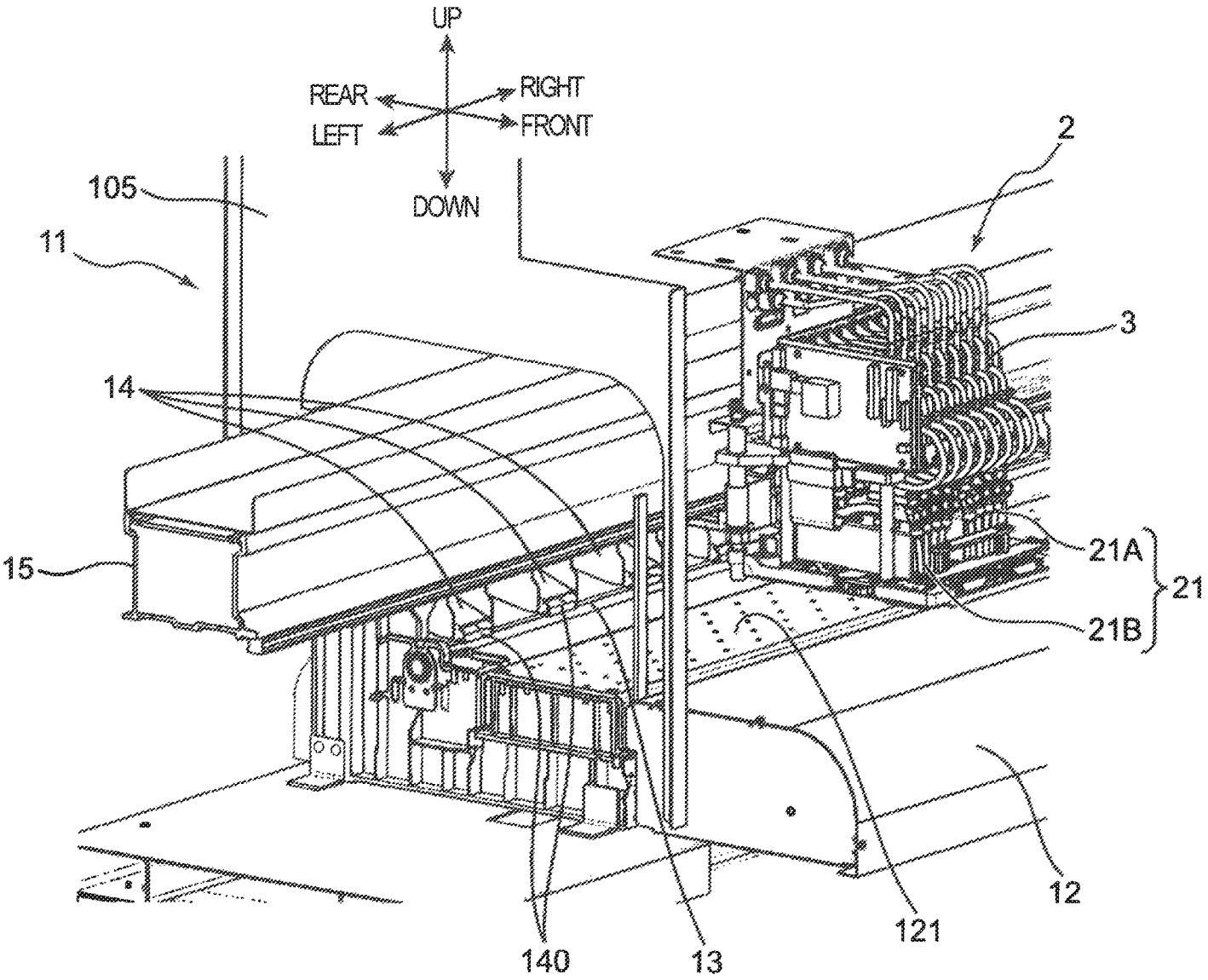
FIG. 4 is an enlarged perspective view of a part of the image forming apparatus in the state where the outer cover is removed.

Hereinafter, with reference to the drawings, one embodiment of the present disclosure is described. First, an image forming apparatus as an inkjet printer in which a liquid processing device according to the present disclosure is used is described. FIG. 1 is a perspective view illustrating an external view of an image forming apparatus 1 according to one embodiment of the present disclosure, and FIG. 2 is a cross-sectional view of the image forming apparatus 1. FIG. 3 is a front view of the image forming apparatus 1 in a state where an outer cover 102 is removed, and FIG. 4 is an enlarged perspective view of a part of the image forming apparatus 1 in the state where the outer cover 102 is removed. Note that direction indications of front and rear, left and right, and up and down are shown in FIGS. 1 to 4, and in the drawings referred to later, but they are for easy description and are not intended to limit any directions.

The image forming apparatus 1 performs print processing of characters and images by an inkjet method on various types of work W such as a paper sheet, a resin sheet, or cloth fabric of various sizes. The image forming apparatus 1 is suitable particularly for print processing on the work W of large size and large length. The image forming apparatus 1 includes a base frame 101 having casters, and an apparatus main body 11 mounted on the base frame 101 so as to perform the print processing (image forming operation).

The apparatus main body 11 includes a work conveying path 12, a convey roller 13, a plurality of pinch roller unit 14, and a carriage 2.

The work conveying path 12 is a conveying path extending in a front and rear direction, so that the work W on which the print processing is preformed is carried into the apparatus main body 11 from its rear side and discharged from its front side.

The convey roller 13 extends in the left and right direction and generates a drive force for intermittently conveying the work W in the work conveying path 12. In other words, the convey roller 13 is rotated about a predetermined axis extending in the left and right direction, and conveys the work W in the front direction (predetermined conveying direction) so that the work W passes an image formation position facing a head unit 21 (an image forming portion).

The pinch roller unit 14 is disposed to face the convey roller 13 from above, and is equipped with a pinch roller 140. The pinch roller 140 forms a conveyance nip together with the convey roller 13. A plurality of the pinch roller units 14 are disposed with predetermined spaces in the left and right direction along the convey roller 13.

A unit that performs print processing on the work W is mounted on the carriage 2. The carriage 2 is a moving body that is reciprocatable in the left and right direction (predetermined movement direction) on the base frame 101. A carriage guide 15 is disposed above the base frame 101 so as to extend in the left and right direction, and is equipped with a guide rail. The guide rail guides the reciprocating movement of the carriage 2. The carriage guide 15 is provided with a timing belt 16 attached in a turnable manner in the left and right direction. The carriage 2 has a fixing part to the timing belt 16. When the timing belt 16 turns forwardly or reversely, the carriage 2 is guided by the guide rail so as to move in the left and right direction.

The print processing is performed in such a manner that the convey roller 13 and the pinch roller unit 14 intermittently convey the work W and that the carriage 2 moves in the left and right direction to print-scan the work W while the work W is stopped. Note that in the work conveying path 12, a platen 121 (FIGS. 2 and 4) having a function of sucking the work W is disposed below a passage route of the carriage 2. In other words, the image formation position for the work W is disposed at the platen 121. When the print processing is performed, the carriage 2 performs the print-scan in a state where the work W is sucked by the platen 121.

The apparatus main body 11 is covered with the outer cover 102. A side station 103 is disposed in a right side area of the outer cover 102. Inside the side station 103, there is an immovable ink cartridge shelf 17 that holds an ink cartridge (not shown) storing ink (predetermined liquid) for the print processing.

A front part of the side station 103 is a carriage retraction area 104 to be a retraction space for the carriage 2. As illustrated in FIG. 3, a left frame 105 and a right frame 106 are disposed to stand on the base frame 101 with a space therebetween corresponding to the work conveying path 12 in the left and right direction. The area between the left and right frames 105 and 106 is a print area in which the print processing can be performed. The carriage guide 15 has a left and right width longer than the print area, and the carriage 2 can move to the right outside of the print area. When the print processing is not performed, the carriage 2 retracts to the carriage retraction area 104.

The rear side of the base frame 101 is provided with a feeding portion 107 housing a feeding roll Wa that is a roll of the work W to be printed. The feeding portion 107 feeds out the work W while a tension roller 109A applies a predetermined tension to the work W.

In addition, the front side of the base frame 101 is provided with a winding portion 108 that houses a winding roll Wb as a roll of work W after the print processing. The winding portion 108 is provided with a drive source (not shown) for driving a roll shaft of the winding roll Wb to rotate, and winds the work W while a tension roller 109B applies a predetermined tension to the work W.

As illustrated in FIG. 4, the carriage 2 is equipped with the head unit 21 that ejects ink (liquid) to the work W and forms an image, and a liquid supply unit 3 that supplies ink from the ink cartridge to the head unit 21.

FIG. 4 shows an example in which the carriage 2 is equipped with two head units 21 including a first head unit 21A and a second head unit 21B, and eight liquid supply units 3. In other words, four liquid supply units 3 are equipped for one head unit 21, in order to supply cyan, magenta, yellow, and black ink.

The carriage 2 reciprocates along the carriage guide 15 in the left and right direction. Note that it may possible to adopt a configuration in which different colors of ink are filled in the liquid supply units 3, respectively, and two head units 21 including the first head unit 21A and the second head unit 21B eject eight colors of ink at most.

[Structure of Carriage]

Figure 5:
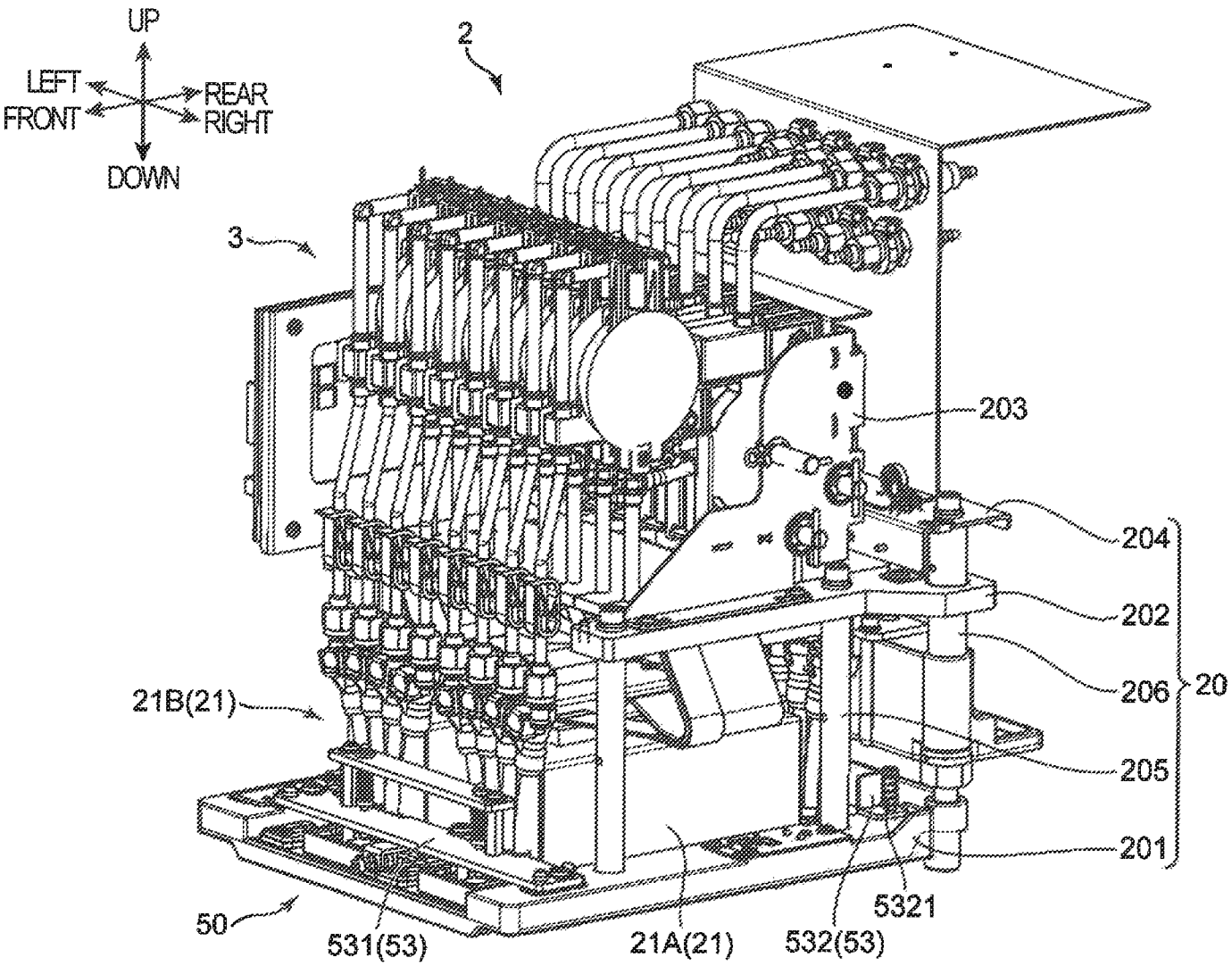
FIG. 5 is an overall perspective view of a carriage provided to the image forming apparatus.
Figure 6:
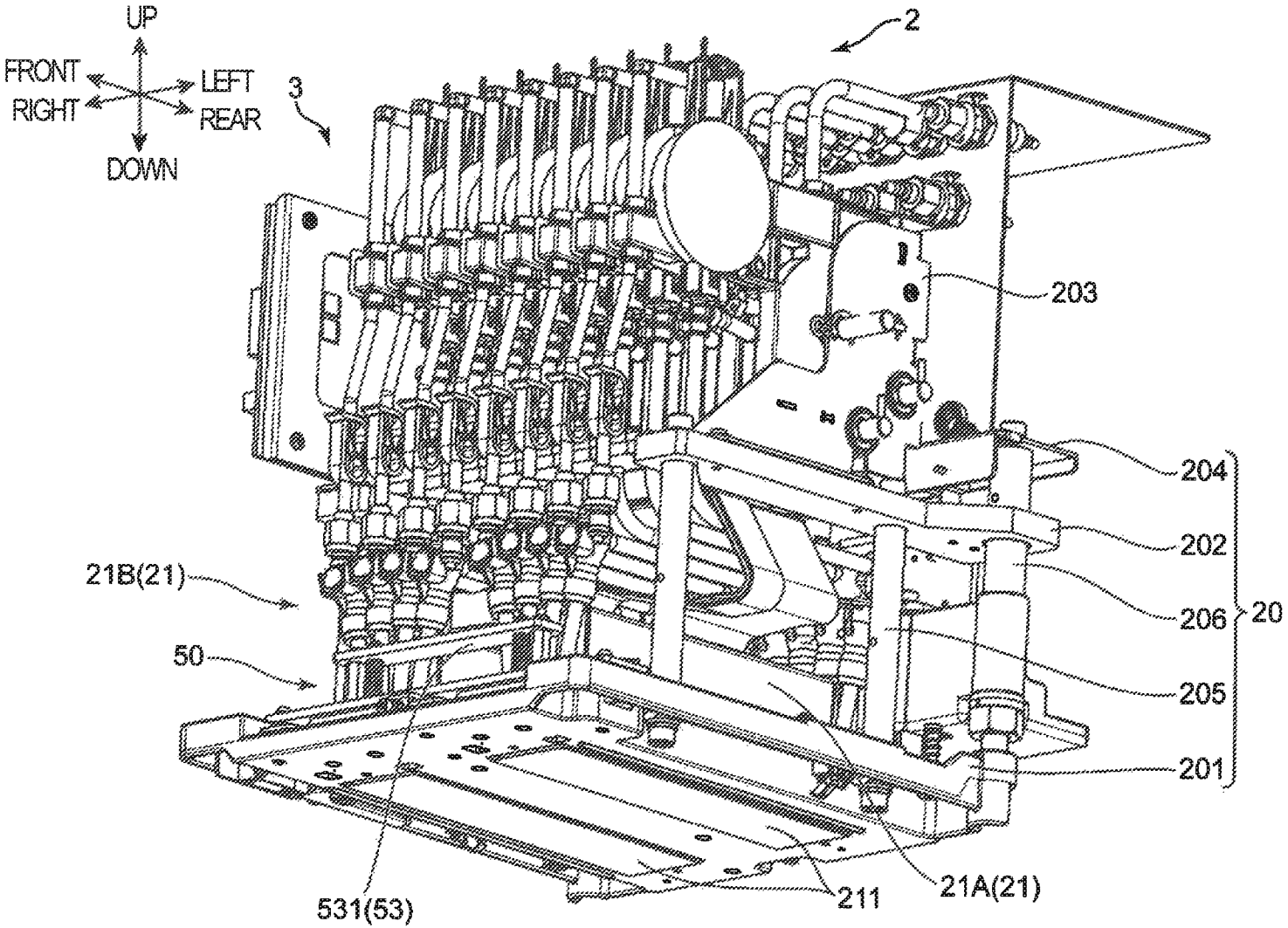
FIG. 6 is an overall perspective view of the carriage.
Figure 7:
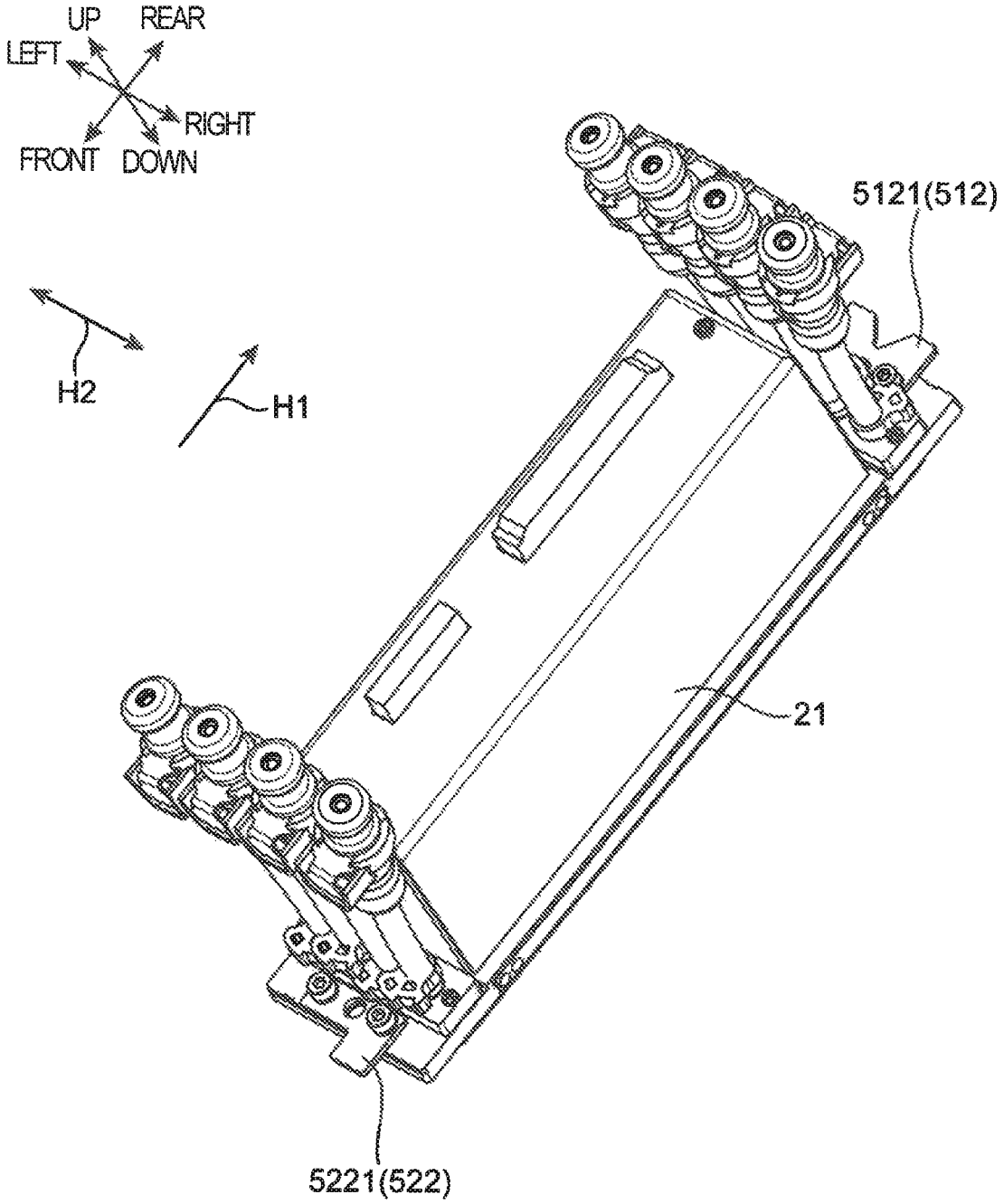
FIG. 7 is a perspective view of a head unit to be mounted on the carriage.
Figure 8:
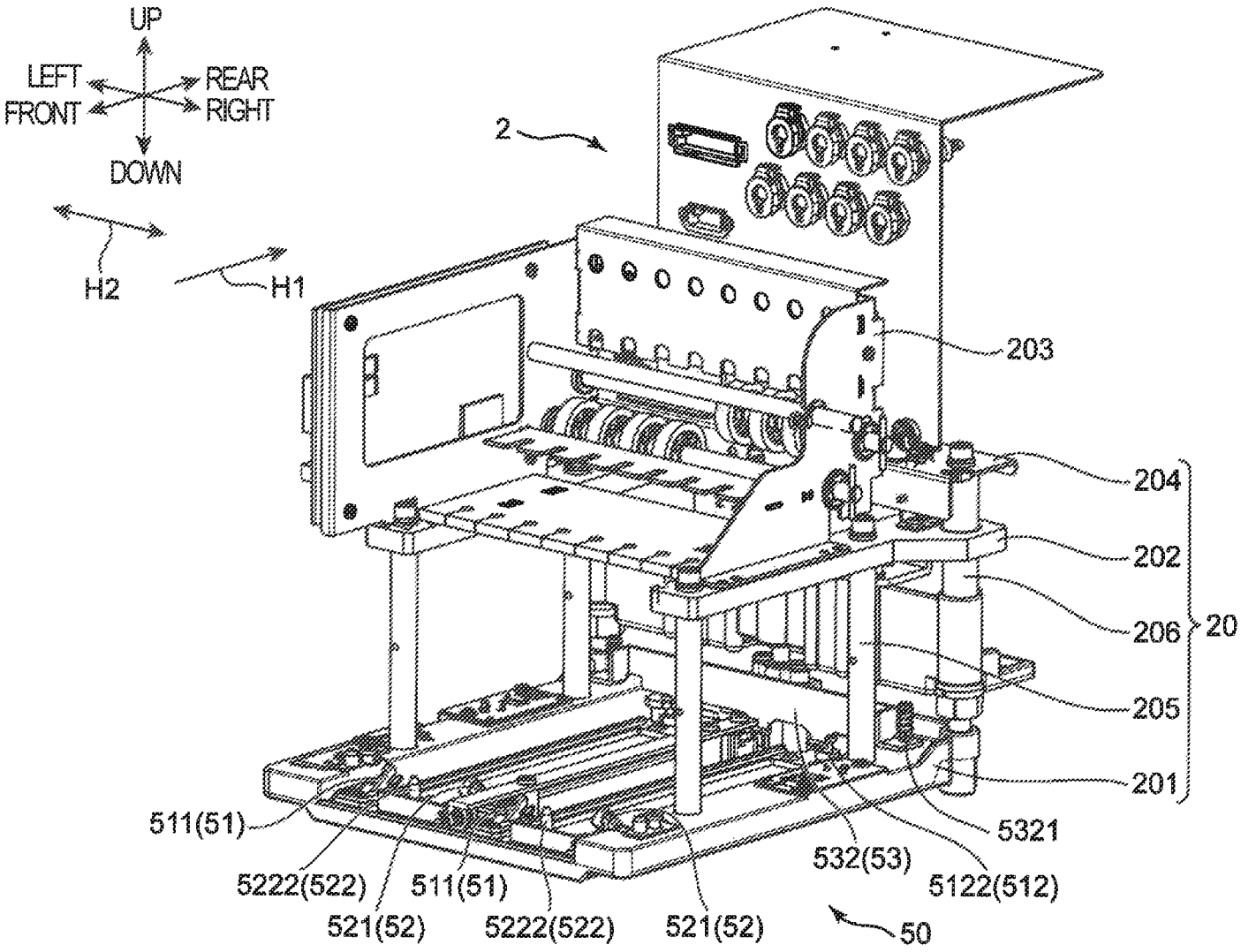
FIG. 8 is a perspective view of the carriage in a state where the head unit is removed.
Figure 9:
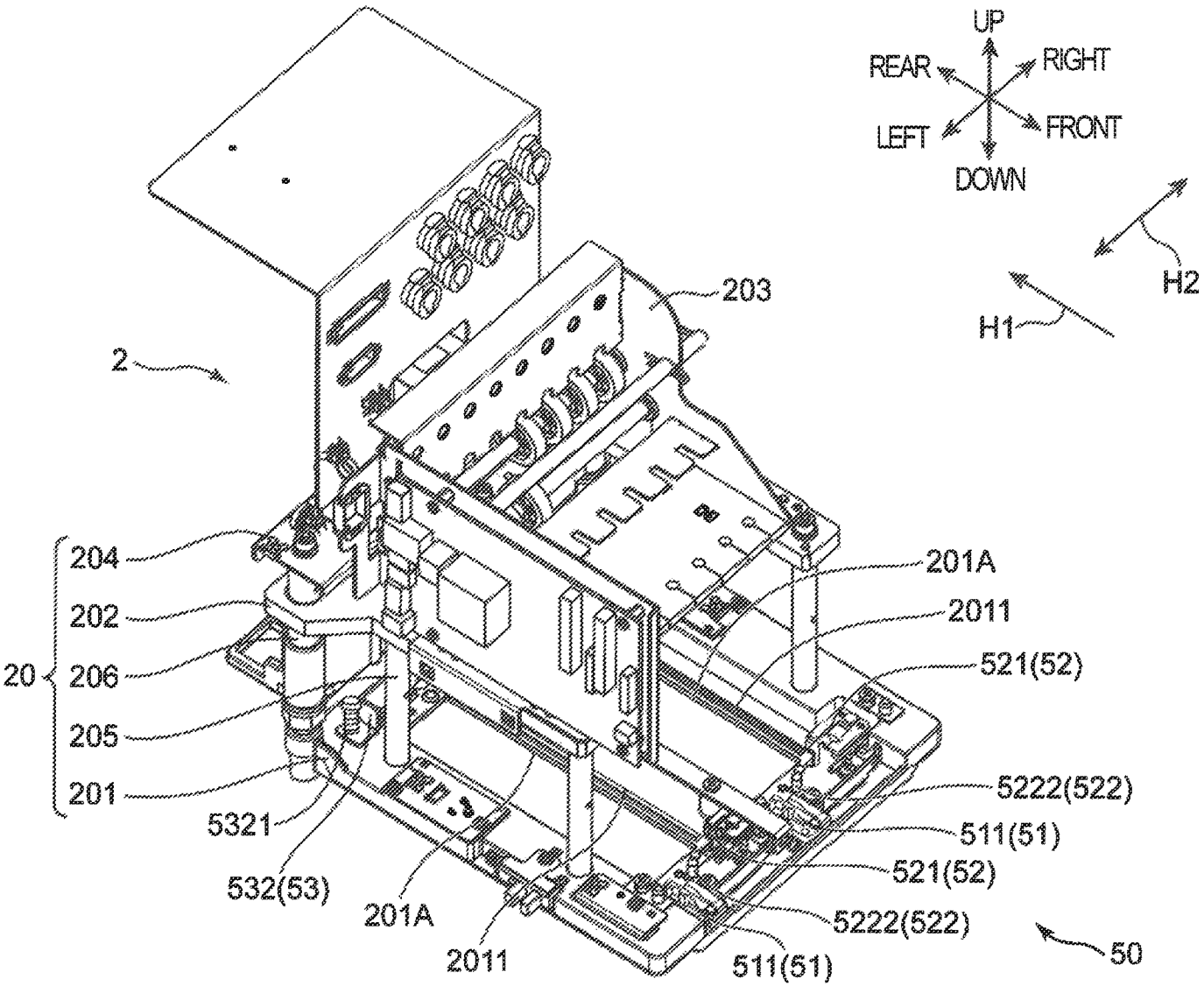
FIG. 9 is a perspective view of the carriage in the state where the head unit is removed.

FIGS. 5 and 6 are overall perspective views of the carriage 2 provided to the image forming apparatus 1. FIG. 7 is a perspective view of the head unit 21 to be mounted on the carriage 2. FIGS. 8 and 9 are perspective views of the carriage 2 in a state where the head unit 21 is removed.

The carriage 2 includes a carriage frame 20 as a head holder that holds the head unit 21. The carriage frame 20 includes a lower frame 201, an upper frame 202, a rack 203, and a rear frame 204. The lower frame 201 is disposed at the lowermost position. The upper frame 202 is disposed above the lower frame 201 with a space therebetween. The rack 203 is attached to the upper surface of the upper frame 202. The rear frame 204 is attached to the back side of the upper frame 202.

The lower frame 201 and the upper frame 202 are connected to each other with connecting posts 205 extending in the up and down direction. The rear frame 204 is provided with a ball screw mechanism (not shown), and a nut driven by a ball screw thereof is attached to the lower frame 201. In addition, the rear frame 204 is provided with a guide post 206 extending in the up and down direction. Driven by the ball screw mechanism, a connected body of the lower frame 201 and the upper frame 202 can move in the up and down direction while being guided by the guide post 206. In other words, a main body part of the carriage 2 can move in the up and down direction with respect to the rear frame 204.

The lower frame 201 constitutes a mounting part of the carriage frame 20, on which the head unit 21 is mounted. An opening 201A is formed to extend in the front and rear direction (FIG. 9) in the lower frame 201. The head unit 21 is mounted on the lower frame 201 so that an ink ejection surface 211 thereof (FIG. 6) is exposed through the opening 201A. As described above, the main body part of the carriage 2 can move in the up and down direction, and hence the height position of the head unit 21 in the up and down direction with respect to the work W can be adjusted. The upper frame 202 is provided with the liquid supply unit 3. The eight liquid supply units 3 are arranged in the left and right direction in the rack 203 and are supported by the upper frame 202. The rear frame 204 is provided with a fixing part to the timing belt 16, and other parts.

As illustrated in FIG. 7, the head unit 21 has a substantially rectangular solid shape, and is attached to the lower frame 201 so that a longitudinal direction perpendicular to a width direction H2 thereof is parallel to the front and rear direction. The head unit 21 is attached to the lower frame 201 by a worker. The head unit 21 is mounted on the lower frame 201 by a worker who performs an operation of moving the same in a mounting direction H1 from the front side to the rear side of the lower frame 201. Note that the mounting direction H1 of the head unit 21 to the lower frame 201 is parallel to the conveying direction of the work W. The head unit 21 mounted on the lower frame 201 is positioned and fixed to the lower frame 201 by a fixing mechanism 50.

[Structure of Fixing Mechanism]

The fixing mechanism 50 is a mechanism for positioning and fixing the head unit 21, which is moved in the mounting direction H1 and mounted with respect to the lower frame 201, to the lower frame 201. The fixing mechanism 50 includes a first positioning part 51, a second positioning part 52, and a third positioning part 53. The first positioning part 51 performs positioning of the head unit 21 in the mounting direction H1 on the horizontal surface with respect to the lower frame 201. The second positioning part 52 performs positioning in the width direction H2 perpendicular to the mounting direction H1 on the horizontal surface. The third positioning part 53 performs positioning in the up and down direction (vertical direction) perpendicular to both the mounting direction H1 and the width direction H2. Note that the width direction H2 of the head unit 21 is parallel to the movement direction of the carriage 2 (the left and right direction).

In addition, in this embodiment, each of the two head units 21 is provided with the first positioning part 51 and the second positioning part 52. The two head units 21 include the first head unit 21A and the second head unit 21B disposed adjacent to the first head unit 21A in the width direction H2.

The third positioning part 53 performs positioning in the up and down direction with respect to both the lower frames 201 of the two head units 21. The first positioning parts 51 provided respectively to the two head units 21 have the same structure, and the second positioning parts 52 also have the same structure.

The first positioning part 51 includes a first pressing member 511 and a first position regulation part 512. The first pressing member 511 is a member that presses the head unit 21 mounted on the lower frame 201 in the mounting direction H1 (in the direction from the front to the rear). More specifically, the first pressing member 511 is disposed on the front side of the opening 201A in an upstream end part (front end part) in the mounting direction H1 of the lower frame 201, and presses the front end part to be one end part in the longitudinal direction of the head unit 21 mounted on the lower frame 201, in the mounting direction H1. Details of the structure of the first pressing member 511 will be described later.

The first position regulation part 512 regulates position of the head unit 21 pressed by the first pressing member 511, in the mounting direction H1 in the lower frame 201. The first position regulation part 512 includes a first engagement part 5121 (FIG. 7) and a second engagement part 5122 (FIG. 8). The first engagement part 5121 is disposed at a downstream end part (rear end part) in the mounting direction H1 of the head unit 21. The second engagement part 5122 is disposed at the rear end part of the lower frame 201, and can engage with the first engagement part 5121. When the first engagement part 5121 and the second engagement part 5122 engage with each other, the position in the mounting direction H1 in the lower frame 201 of the head unit 21 pressed by the first pressing member 511 can be regulated. In this way, the head unit 21 is positioned in the mounting direction H1 in the lower frame 201.

The second positioning part 52 includes a second pressing member 521 and a second position regulation part 522. The second pressing member 521 is a member that presses the head unit 21 mounted on the lower frame 201 to one side (the left side) in the width direction H2. More specifically, the second pressing member 521 is disposed on the on the front and right side of the opening 201A in an upstream end part (front end part) in the mounting direction H1 of the lower frame 201, and presses the front end part to be one end part in the longitudinal direction of the head unit 21 mounted on the lower frame 201 to one side (the left side) in the width direction H2. Details of the structure of the second pressing member 521 will be described later.

The second position regulation part 522 regulates position of the head unit 21 pressed by the second pressing member 521 in the width direction H2 in the lower frame 201. The second position regulation part 522 includes a third engagement part 5221 (FIG. 7) and a fourth engagement part 5222 (FIG. 8). The third engagement part 5221 is disposed at an upstream end part (front end part) in the mounting direction H1 of the head unit 21. The fourth engagement part 5222 is disposed at the front end part of the lower frame 201, and can engage with the third engagement part 5221. When the third engagement part 5221 and the fourth engagement part 5222 engage with each other, the position in the width direction H2 in the lower frame 201 of the head unit 21 pressed by the second pressing member 521 can be regulated. In this way, the head unit 21 is positioned in the width direction H2 in the lower frame 201.

The third positioning part 53 includes a third pressing member 531 (FIGS. 5 and 6) and a fourth pressing member 532 (FIGS. 5, 8, and 9). The third pressing member 531 is a member that extends in the width direction H2 of the head unit 21 (in the left and right direction), and presses downward the upstream end part in the mounting direction H1 of the head unit 21 mounted on the lower frame 201 (the front end part, or a part at which the third engagement part 5221 is disposed). The third pressing member 531 is fixed to the front end part of the lower frame 201 while pressing downward the upstream end part in the mounting direction H1 of the head unit 21.

The fourth pressing member 532 is a member that extends in the width direction H2 of the head unit 21 (in the left and right direction), and presses downward the downstream end part in the mounting direction H1 of the head unit 21 mounted on the lower frame 201 (the rear end part, or a part at which the first engagement part 5121 is disposed). The fourth pressing member 532 is fixed to the rear end part of the lower frame 201 via a spring member 5321 in a rockable manner in the up and down direction while pressing downward the downstream end part of the head unit 21 in the mounting direction H1. The third pressing member 531 and the fourth pressing member 532 press the head unit 21 downward, and hence can regulate the position of the head unit 21 in the up and down direction in the lower frame 201. In this way, the head unit 21 is positioned in the up and down direction in the lower frame 201.

<Detailed Structure of First Pressing Member and Second Pressing Member>

The first pressing member 511 of the first positioning part 51 and the second pressing member 521 of the second positioning part 52 have the same structure except for orientation with respect to the lower frame 201. With reference to FIGS. 10A, 10B, and 11 to 17, structures of the first pressing member 511 and the second pressing member 521 are described in detail.

Figure 10A:
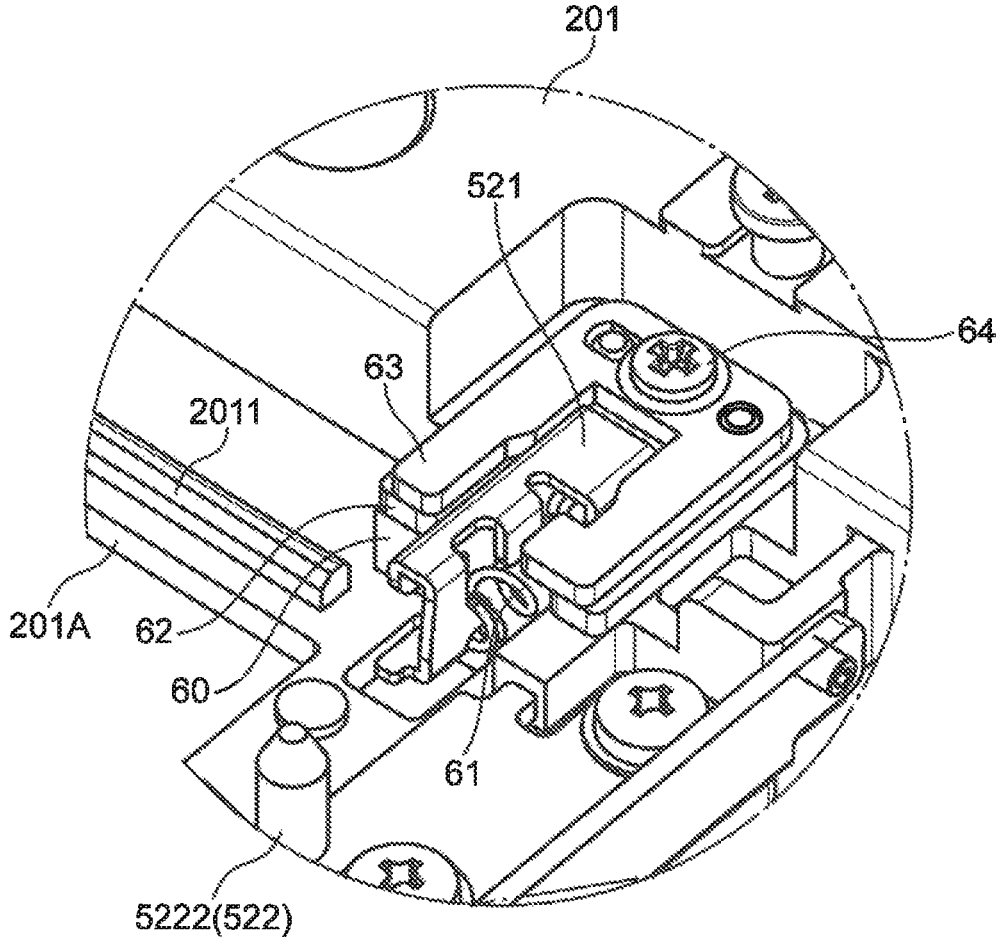
FIG. 10A is an enlarged perspective view of a pressing member disposed at a lower frame of a carriage frame in a fixing mechanism provided to the image forming apparatus.
Figure 10B:
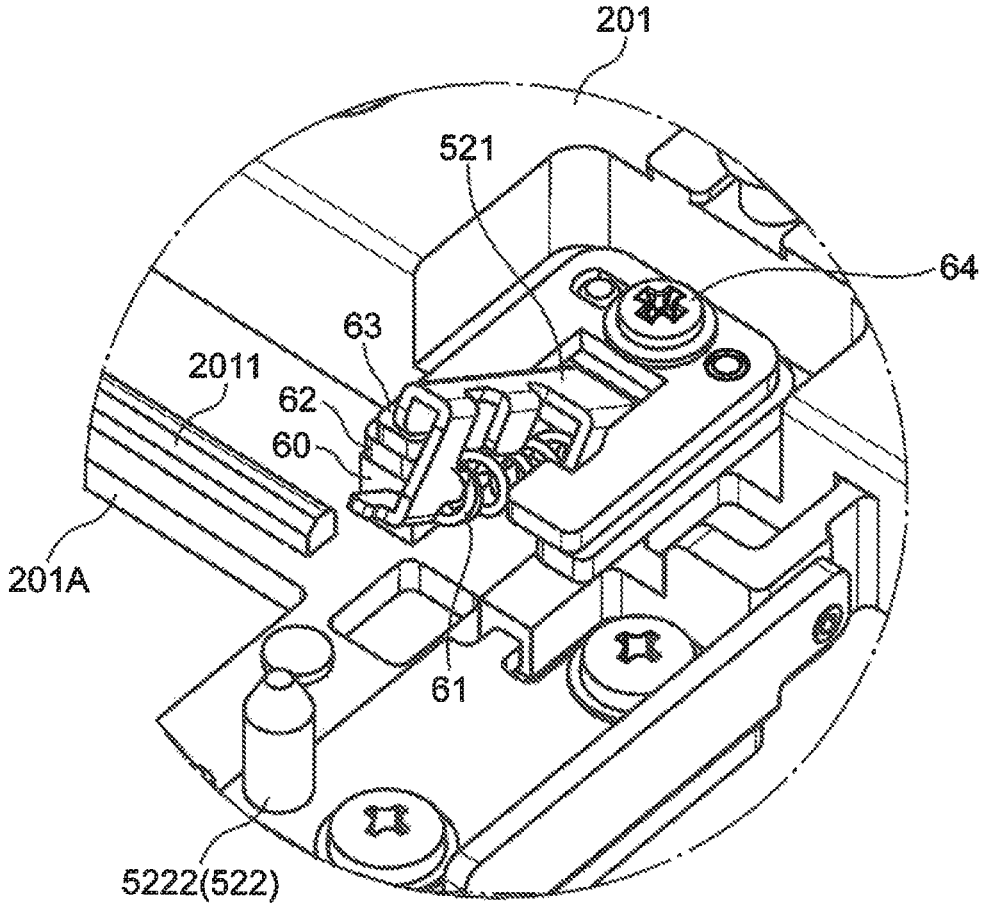
FIG. 10B is an enlarged perspective view of the pressing member disposed at the lower frame of the carriage frame in the fixing mechanism provided to the image forming apparatus.

FIGS. 10A and 10B are enlarged perspective views of the second pressing member 521. FIG. 10A shows a state of the second pressing member 521 in a first posture, and FIG. 10B shows a state of the second pressing member 521 in a second posture. Note that FIGS. 10A and 10B do not show the first pressing member 511, and the first pressing member 511 has the same structure as the second pressing member 521.

Figure 11:
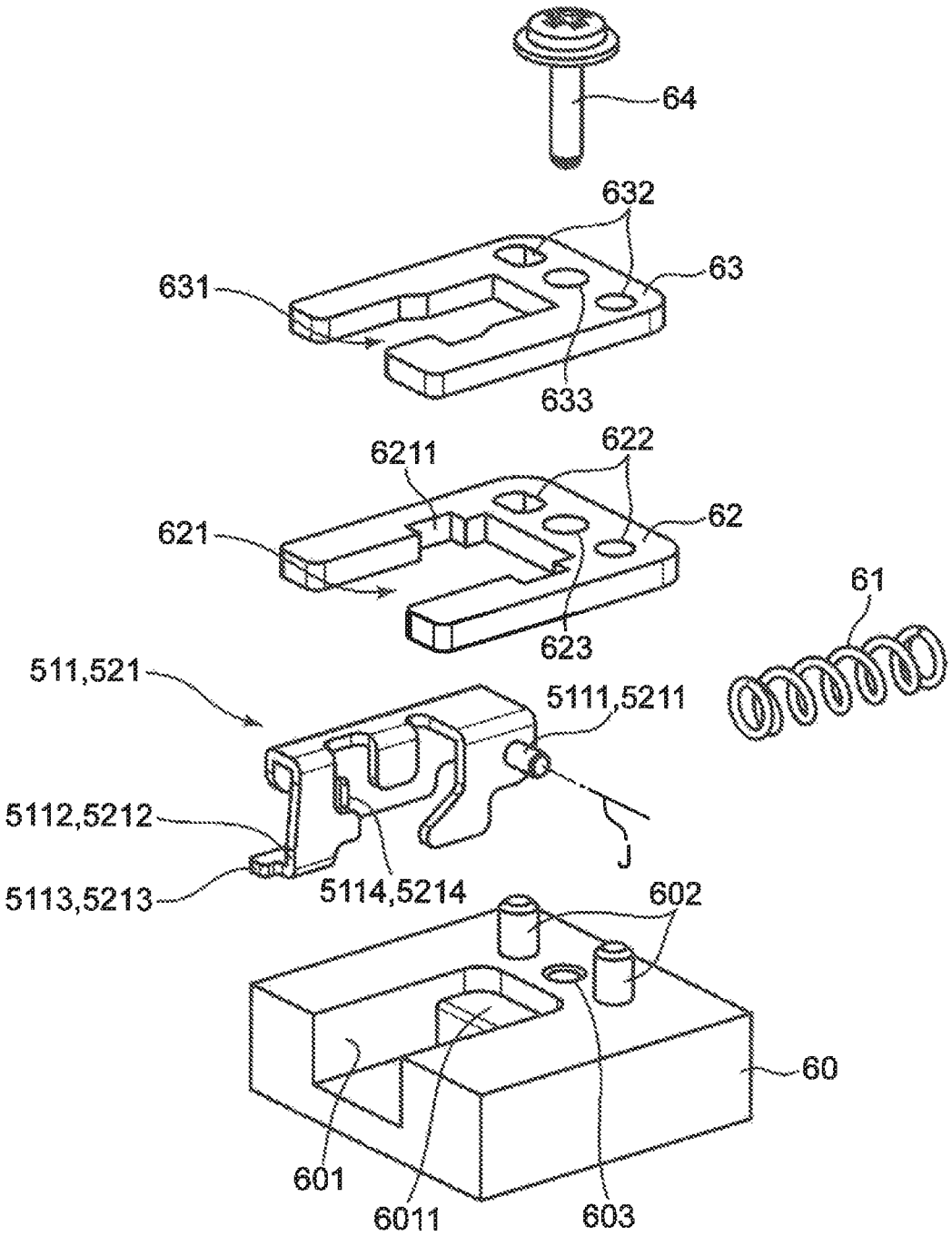
FIG. 11 is an exploded perspective view of the pressing member and members holding the pressing member.
Figure 12:
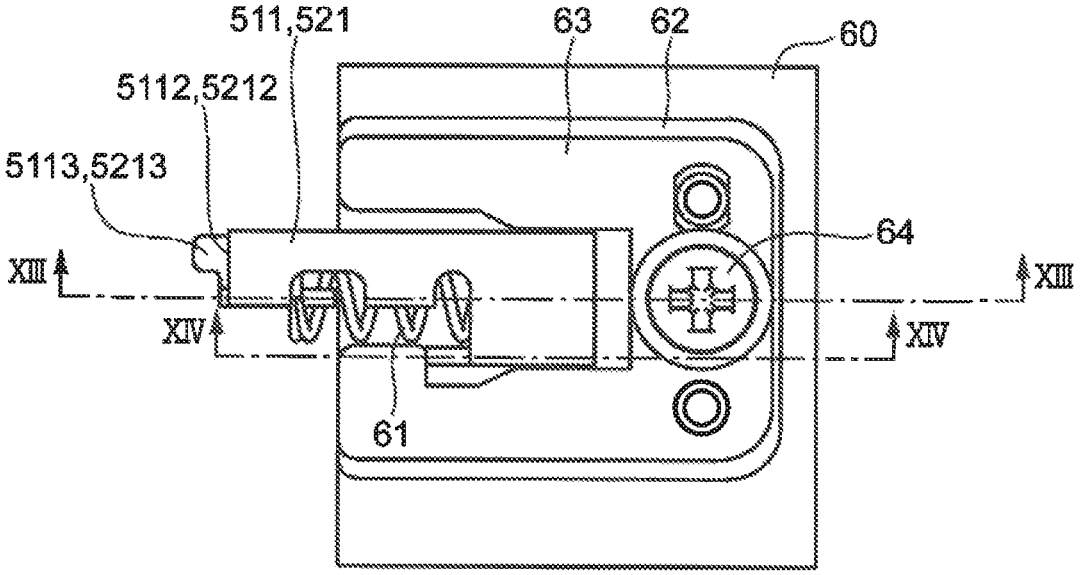
FIG. 12 is a plan view of the pressing member in a first posture viewed from above.
Figure 13:
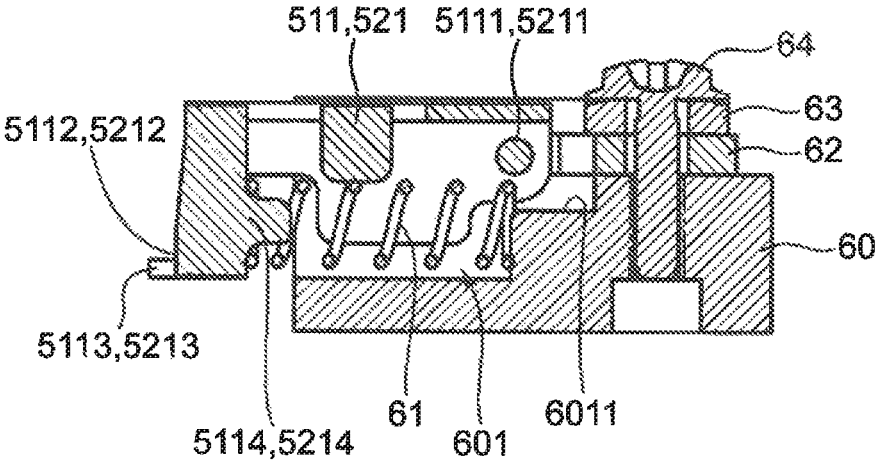
FIG. 13 is a cross-sectional view of FIG. 12 taken along the line XIII-XIII.
Figure 14:
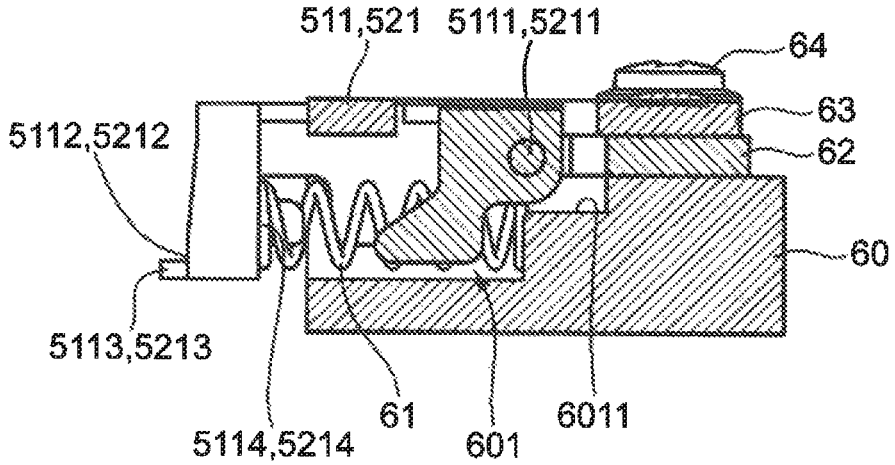
FIG. 14 is a cross-sectional view of FIG. 12 taken along the line XIV-XIV.
Figure 15:
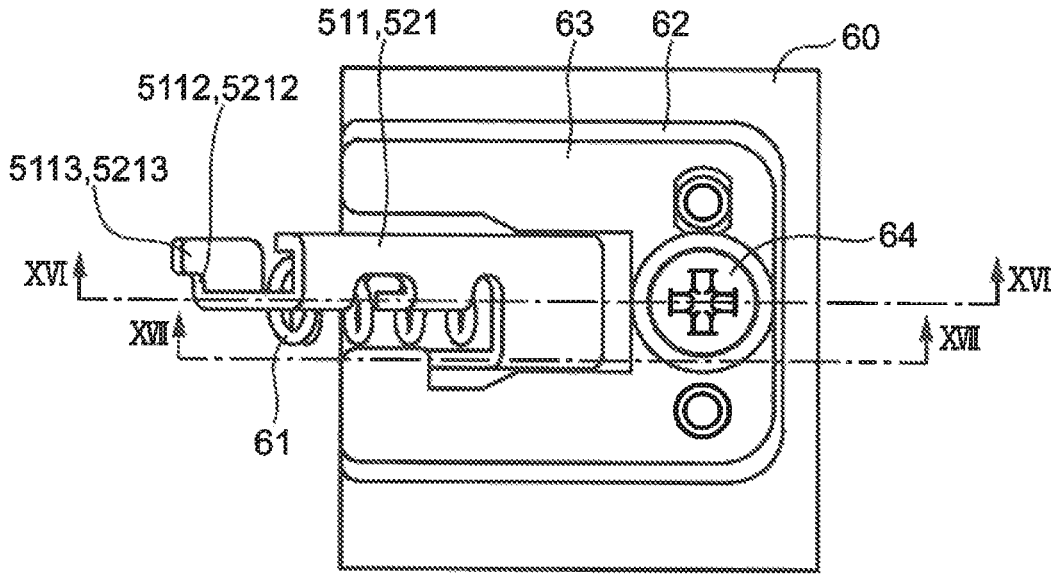
FIG. 15 is a plan view of the pressing member in a second posture viewed from above.
Figure 16:
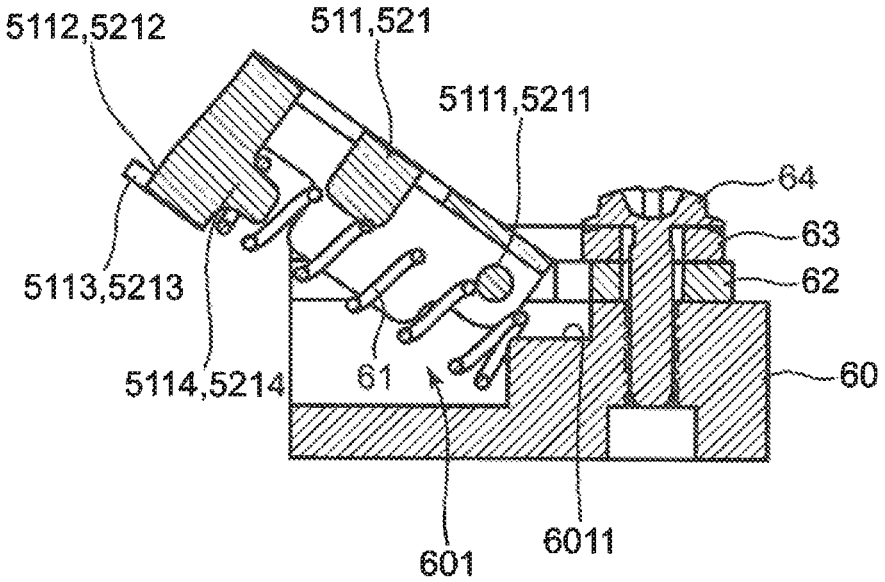
FIG. 16 is a cross-sectional view of FIG. 15 taken along the line XVI-XVI.
Figure 17:
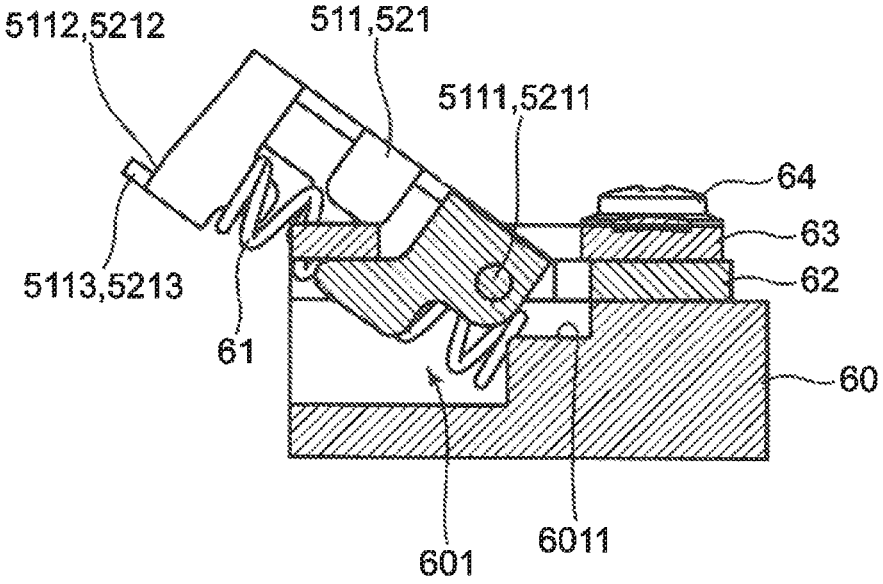
FIG. 17 is a cross-sectional view of FIG. 15 taken along the line XVII-XVII.

FIG. 11 is an exploded perspective view of the first pressing member 511, the second pressing member 521, and members holding the pressing members 511 and 521. FIG. 12 is a plan view of the first and second pressing members 511 and 521 in the first posture viewed from above. FIG. 13 is a cross-sectional view of FIG. 12 taken along the line XIII-XIII, and FIG. 14 is a cross-sectional view of FIG. 12 taken along the line XIV-XIV. FIG. 15 is a plan view of the first and second pressing members 511 and 521 in the second posture viewed from above. FIG. 16 is a cross-sectional view of FIG. 15 taken along the line XVI-XVI, and FIG. 17 is a cross-sectional view of FIG. 15 taken along the line XVII-XVII.

Each of the first pressing member 511 and the second pressing member 521 is a member having a predetermined length. The first pressing member 511 is disposed on the lower frame 201 so that its longitudinal direction is parallel to the mounting direction H1. The second pressing member 521 is disposed on the lower frame 201 so that its longitudinal direction is parallel to the width direction H2.

The first pressing member 511 and the second pressing member 521 respectively have shaft parts 5111 and 5211 at one end parts in the longitudinal direction, and on the other end parts in the longitudinal direction (distal end parts) opposite to the shaft parts 5111 and 5211, there are pressing parts 5112 and 5212 that press the head unit 21. Further, the first pressing member 511 and the second pressing member 521 respectively have protrusions 5113 and 5213 protruding outward from the pressing parts 5112 and 5212, and latching parts 5114 and 5214 with which one end part of a coil spring member 61 (resilience member) is latched.

The shaft part 5111 of the first pressing member 511 extends along the width direction H2 of the head unit 21. The first pressing member 511 is rotatable about an axis J of the shaft part 5111, so that it can change its posture between a first posture that is horizontal (the posture shown in FIGS. 10A and 12 to 14) and a second posture inclined upward at its end from the first posture (the posture shown in FIGS. 10B and 15 to 17). Further, when the coil spring member 61 whose one end part is latched with the latching part 5114 is compressed or expanded, the first pressing member 511 can rock in the direction of pressing the head unit 21 (in the mounting direction H1).

Further, when the head unit 21 is not mounted on the lower frame 201, the first pressing member 511 is in the second posture. When the first pressing member 511 is in the second posture in this way, the coil spring member 61 is most expanded.

On the contrary, when the head unit 21 is mounted on the lower frame 201, the first pressing member 511 becomes the first posture. When the first pressing member 511 is in the first posture in this way, the coil spring member 61 is most compressed. When the first pressing member 511 is in the first posture, it presses the head unit 21 in the mounting direction H1 via the pressing part 5112 by a restoring force of the compressed coil spring member 61. Note that the head unit 21 pressed by the first pressing member 511 in the first posture abuts the protrusion 5113 of the first pressing member 511 at a lower end edge of the front end part to be one end part in its longitudinal direction.

In addition, as illustrated in FIGS. 13 and 14, in a state where the first pressing member 511 presses the head unit 21, i.e., in a state where the first pressing member 511 is in the first posture, the center of the latching part 5114 receiving the restoring force of the coil spring member 61 is disposed lower than the shaft part 5111 to be a rotation fulcrum. Further the pressing part 5112 is disposed lower than the latching part 5114. In other words, when the first pressing member 511 is in the first posture, the shaft part 5111, the latching part 5114, and the pressing part 5112 are arranged in this order from top to bottom. The head unit 21 is pressed in the mounting direction H1 via the pressing part 5112 in this arrangement, and hence the first pressing member 511 in the first posture rotates upward about the shaft part 5111, so that a change of posture to the second posture can be prevented. Therefore, the head unit 21 pressed by the first pressing member 511 can be prevented from rising upward.

The shaft part 5211 of the second pressing member 521 extends along the mounting direction H1 of the head unit 21. The second pressing member 521 can rotate about the axis J of the shaft part 5211, so that it can change its posture between a first posture that is horizontal (the posture shown in FIGS. 10A and 12 to 14) and a second posture inclined upward at its end from the first posture (the posture shown in FIGS. 10B and 15 to 17). Further, when the coil spring member 61 whose one end part is latched with the latching part 5214 is compressed or expanded, the second pressing member 521 can rock in the direction of pressing the head unit 21 (to one side in the width direction H2).

Further, when the head unit 21 is not mounted on the lower frame 201, the second pressing member 521 is in the second posture. When the second pressing member 521 is in the second posture in this way, the coil spring member 61 is most expanded. On the contrary, when the head unit 21 is mounted on the lower frame 201, the second pressing member 521 becomes the first posture. In this way, when the second pressing member 521 is in the first posture, the coil spring member 61 is most compressed. When the second pressing member 521 is in the first posture, it presses the head unit 21 to one side in the width direction H2 via the pressing part 5212 by the restoring force of the compressed coil spring member 61. Note that the head unit 21 pressed by the second pressing member 521 in the first posture abuts the protrusion 5213 of the second pressing member 521 at a lower end edge of the front end part to be one end part in its longitudinal direction.

In addition, as illustrated in FIGS. 13 and 14, in a state where the second pressing member 521 presses the head unit 21, i.e., in a state where the second pressing member 521 is in the first posture, the center of the latching part 5214 receiving the restoring force of the coil spring member 61 is disposed lower than the shaft part 5211 to be a rotation fulcrum. Further the pressing part 5212 is disposed lower than the latching part 5214. In other words, when the second pressing member 521 is in the first posture, the shaft part 5211, the latching part 5214, and the pressing part 5212 are arranged in this order from top to bottom. The head unit 21 is pressed to one side in the width direction H2 via the pressing part 5212 in this arrangement, and hence the second pressing member 521 in the first posture rotates upward about the shaft part 5211, so that a change of posture to the second posture can be prevented. Therefore, the head unit 21 pressed by the second pressing member 521 can be prevented from rising upward.

Each of the first pressing member 511 and the second pressing member 521 is held by a holder 60 and disposed on the lower frame 201. The holder 60 has a housing recess 601 that houses the first pressing member 511 or the second pressing member 521, and a step part 6011 is formed in the housing recess 601. In a state where the first pressing member 511 or the second pressing member 521 is housed in the housing recess 601, one end part of the coil spring member 61 is latched with the latching part 5114 or 5214, and the other end part of the same abuts the step part 6011.

In addition, each of the first pressing member 511 and the second pressing member 521 is housed in the housing recess 601 and is prevented from falling out by a first retaining member 62 and a second retaining member 63, so as to be held by the holder 60.

The first retaining member 62 has a notch part 621. The notch part 621 is formed to allow the first pressing member 511 or the second pressing member 521 housed in the housing recess 601 to change its posture between the first posture and the second posture. This notch part 621 has a shaft part notch section 6211, which accommodates the shaft part 5111 or 5211 of the first pressing member 511 or the second pressing member 521 housed in the housing recess 601. In addition, the first retaining member 62 has pin insertion holes 622 and a screw insertion hole 623. Protruding pins 602 of the holder 60 are inserted into the pin insertion holes 622. A screw member 64 is inserted into the screw insertion hole 623. The first retaining member 62 is mounted to the holder 60 so that the protruding pins 602 are inserted into the pin insertion holes 622. In this state, the screw member 64 inserted into the screw insertion hole 623 is inserted into a threaded hole 603 of the holder 60, and hence the first retaining member 62 is screw-fixed to the holder 60.

The second retaining member 63 has a notch part 631. The notch part 631 is formed to allow the first pressing member 511 or the second pressing member 521 housed in the housing recess 601 to change its posture between the first posture and the second posture. In addition, in the same manner as the first retaining member 62, the second retaining member 63 has pin insertion holes 632 and a screw insertion hole 633. The protruding pins 602 of the holder 60 are inserted into the pin insertion holes 632. The screw member 64 is inserted into the screw insertion hole 633. The second retaining member 63 is overlaid on the first retaining member 62 on the holder 60 so that the protruding pins 602 are inserted into the pin insertion holes 632. In this state, the screw member 64 inserted into the screw insertion hole 633 is inserted into the threaded hole 603 of the holder 60, and hence the second retaining member 63 is on the first retaining member 62 and is screw-fixed to the holder 60.

As described above, in the image forming apparatus 1 according to this embodiment, the head unit 21 is moved in a predetermined mounting direction H1 and mounted on the lower frame 201. The head unit 21 mounted on the lower frame 201 is pressed by the first pressing member 511 in the mounting direction H1 so that it is positioned in the mounting direction H1. Further, it is pressed by the second pressing member 521 to one side in the width direction H2 so that it is positioned in the width direction H2. In this way, the head unit 21 is appropriately positioned and fixed to the lower frame 201.

Here, each of the first pressing member 511 and the second pressing member 521 is rotatable and can change its posture between the first posture and the second posture inclined upward at its end. In addition, each of the first pressing member 511 and the second pressing member 521 is disposed to the lower frame 201 in a rockable manner in the direction of pressing the head unit 21, and presses the head unit 21 in the first posture. Each of the first pressing member 511 and the second pressing member 521 is rockable in the direction of pressing the head unit 21, and hence it can press the head unit 21 with an appropriate pressing force in the first posture. In addition, when each of the first pressing member 511 and the second pressing member 521 presses the head unit 21, it is in the first posture, while when it is in the second posture, the pressing force to the head unit 21 is released. Therefore, when the head unit 21 is mounted on the lower frame 201, in an operation of moving the head unit 21 in the mounting direction H1 with respect to the lower frame 201, each of the first pressing member 511 and the second pressing member 521 is set to the second posture, and hence the head unit 21 is prevented from receiving frictional resistance from each of the pressing members 511 and 521. As a result, workability in the mounting operation of the head unit 21 to the lower frame 201 can be improved.

<Relationship Between Mounting Operation of Head Unit and Rotation of Pressing Member>

As described above, the mounting of the head unit 21 to the lower frame 201 is performed by a worker. A relationship between the mounting operation of the head unit 21 to the lower frame 201 and rotations of the first pressing member 511 and the second pressing member 521 is described with reference to FIGS. 18 to 24.

Figure 18:
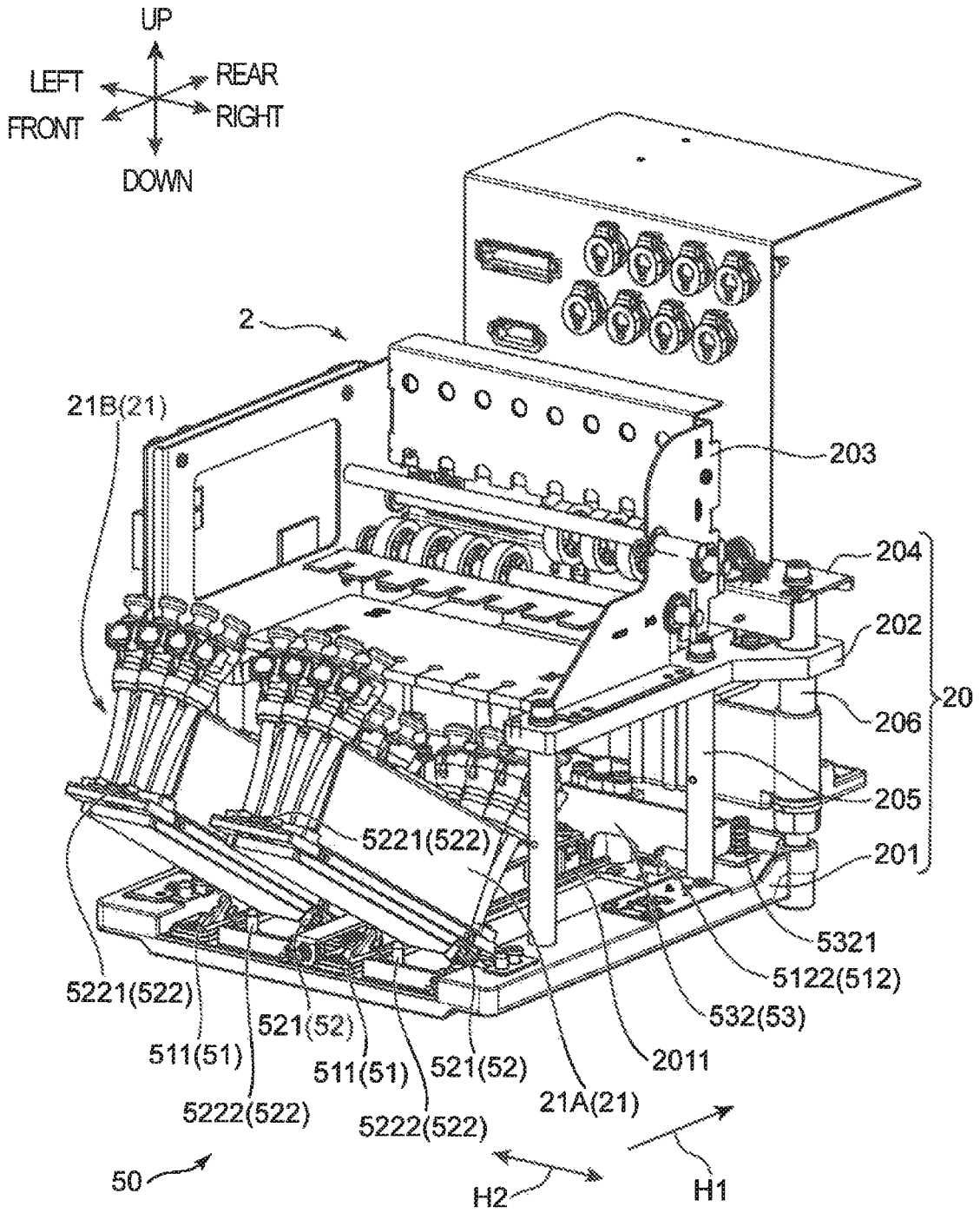
FIG. 18 is a perspective view of the carriage while a first operation is being performed when mounting the head unit to the lower frame.
Figure 19:
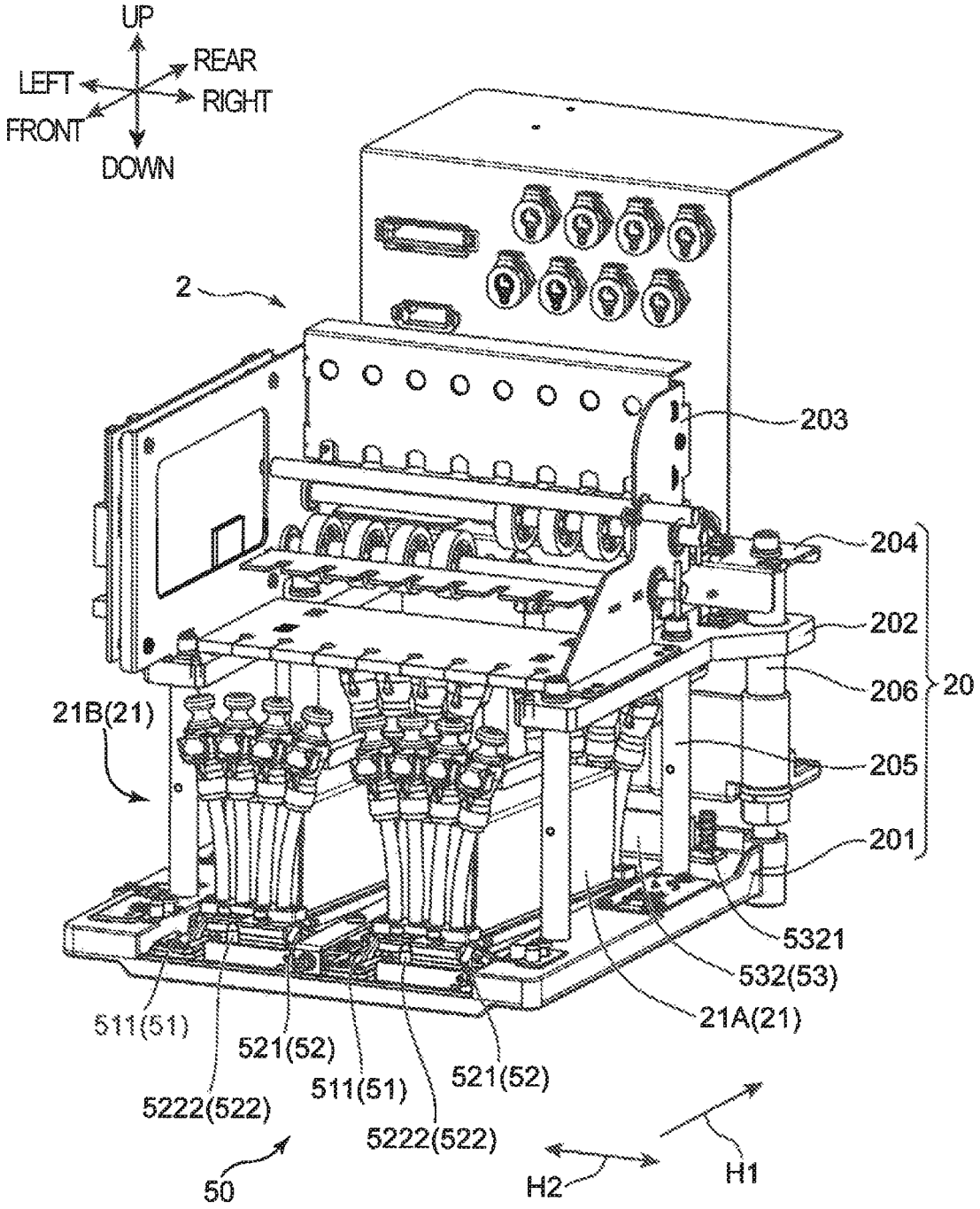
FIG. 19 is a perspective view of the carriage while the first operation is being performed when mounting the head unit to the lower frame.
Figure 20:
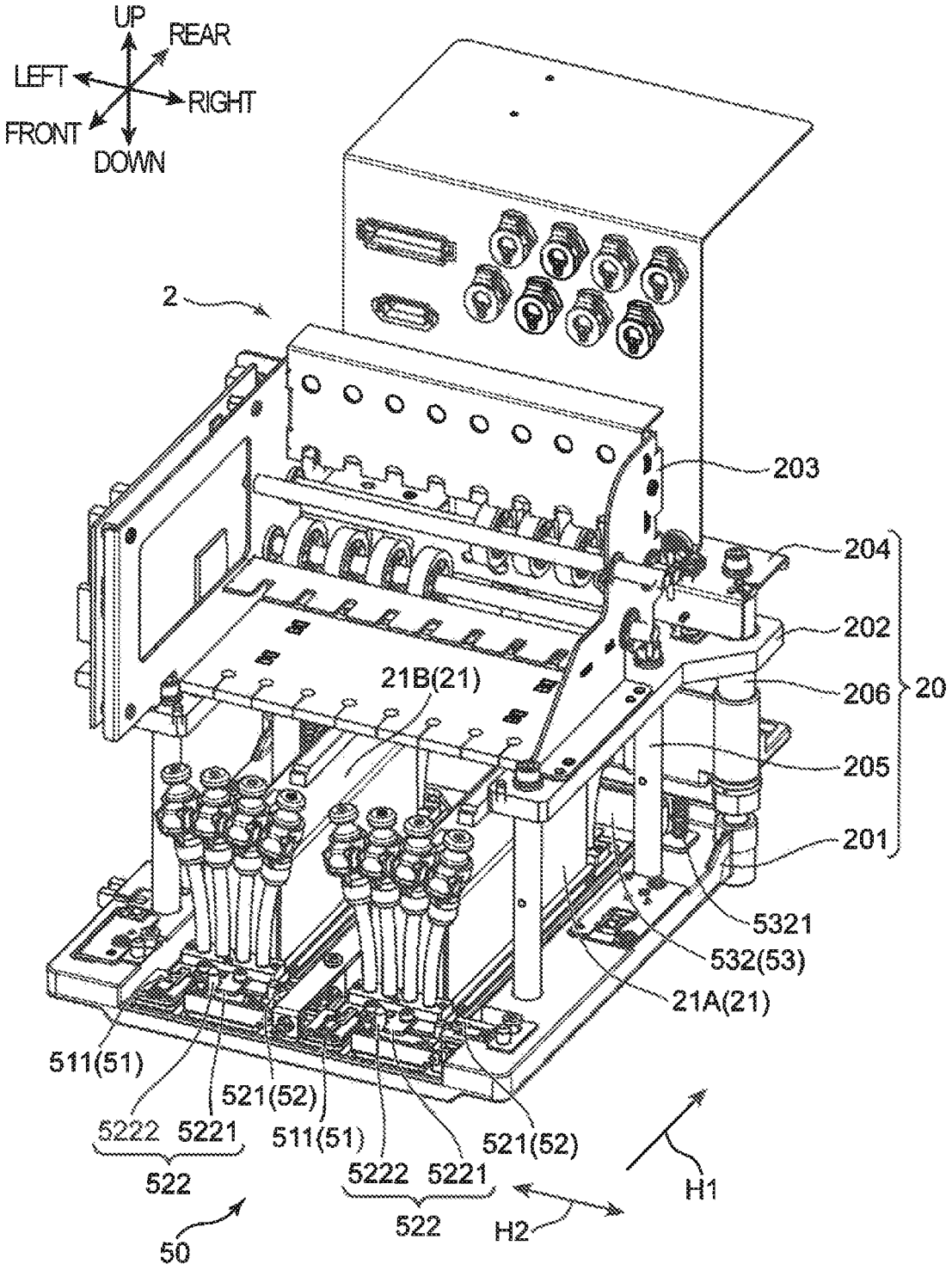
FIG. 20 is a perspective view of the carriage in a state where the head unit is mounted on the lower frame after a second operation when mounting the head unit to the lower frame.
Figure 21:
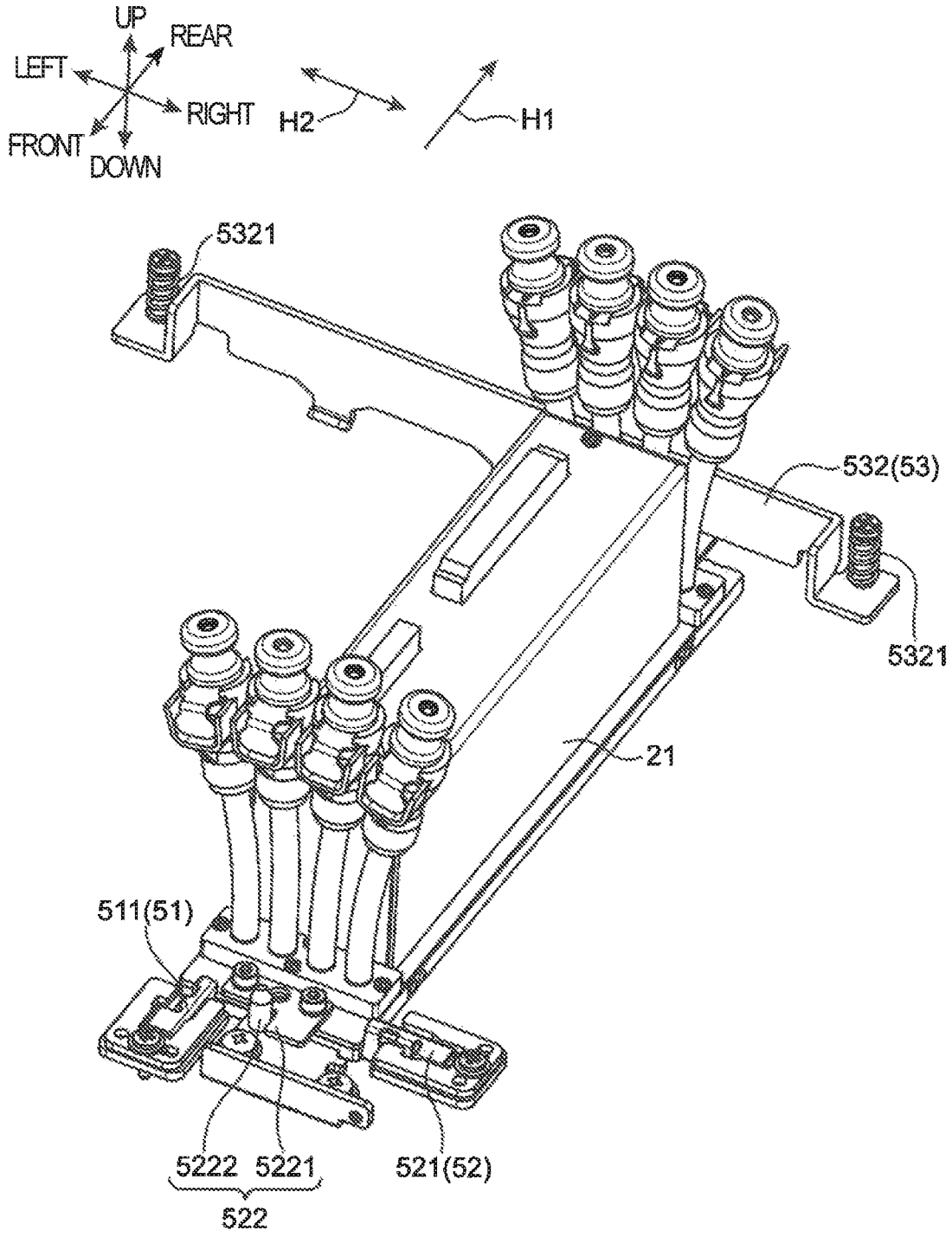
FIG. 21 is a perspective view illustrating a state where the head unit is positioned and fixed by the fixing mechanism in the state where it is mounted on the lower frame.
Figure 22:
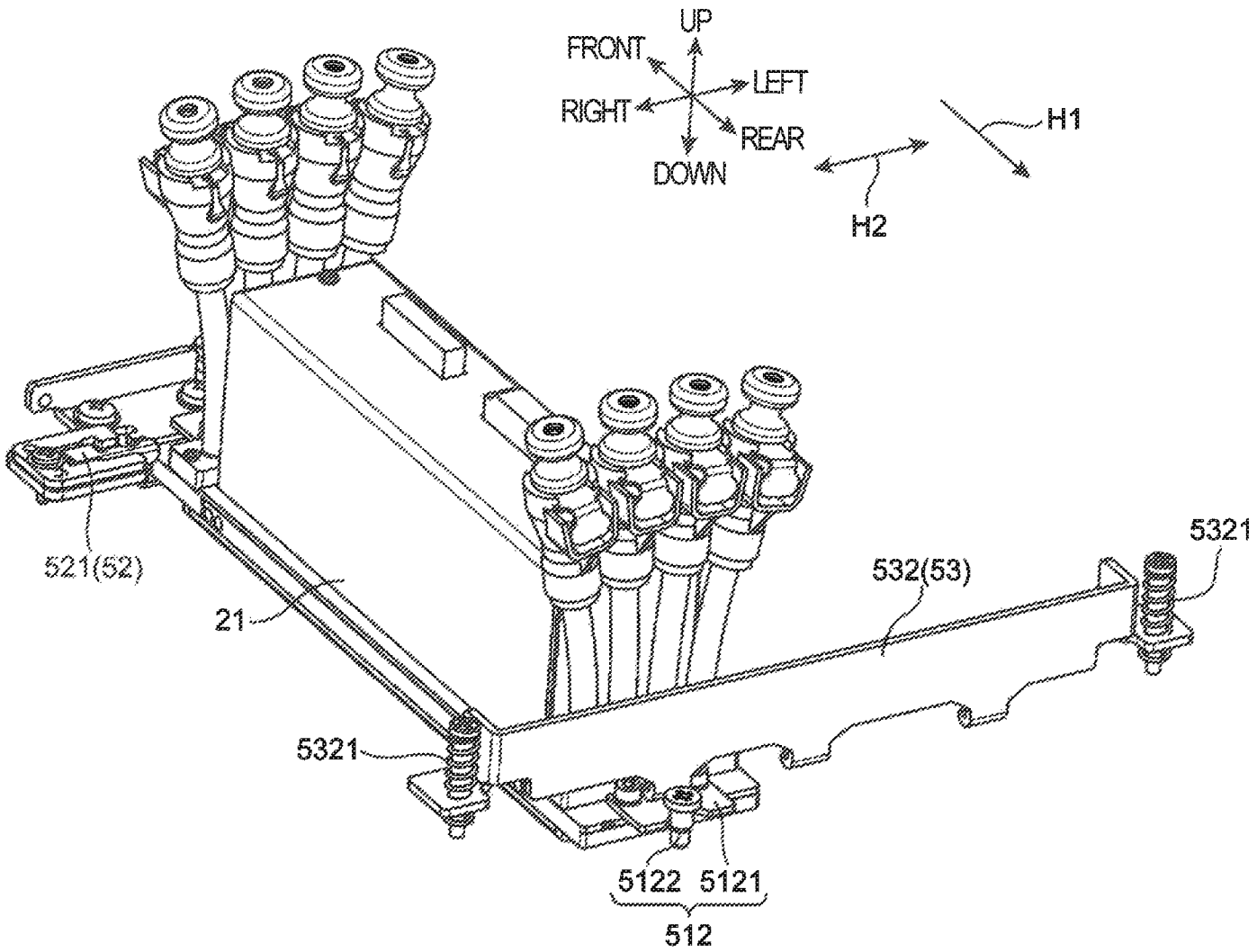
FIG. 22 is a perspective view illustrating a state where the head unit is positioned and fixed by the fixing mechanism in the state where it is mounted on the lower frame.
Figure 23:
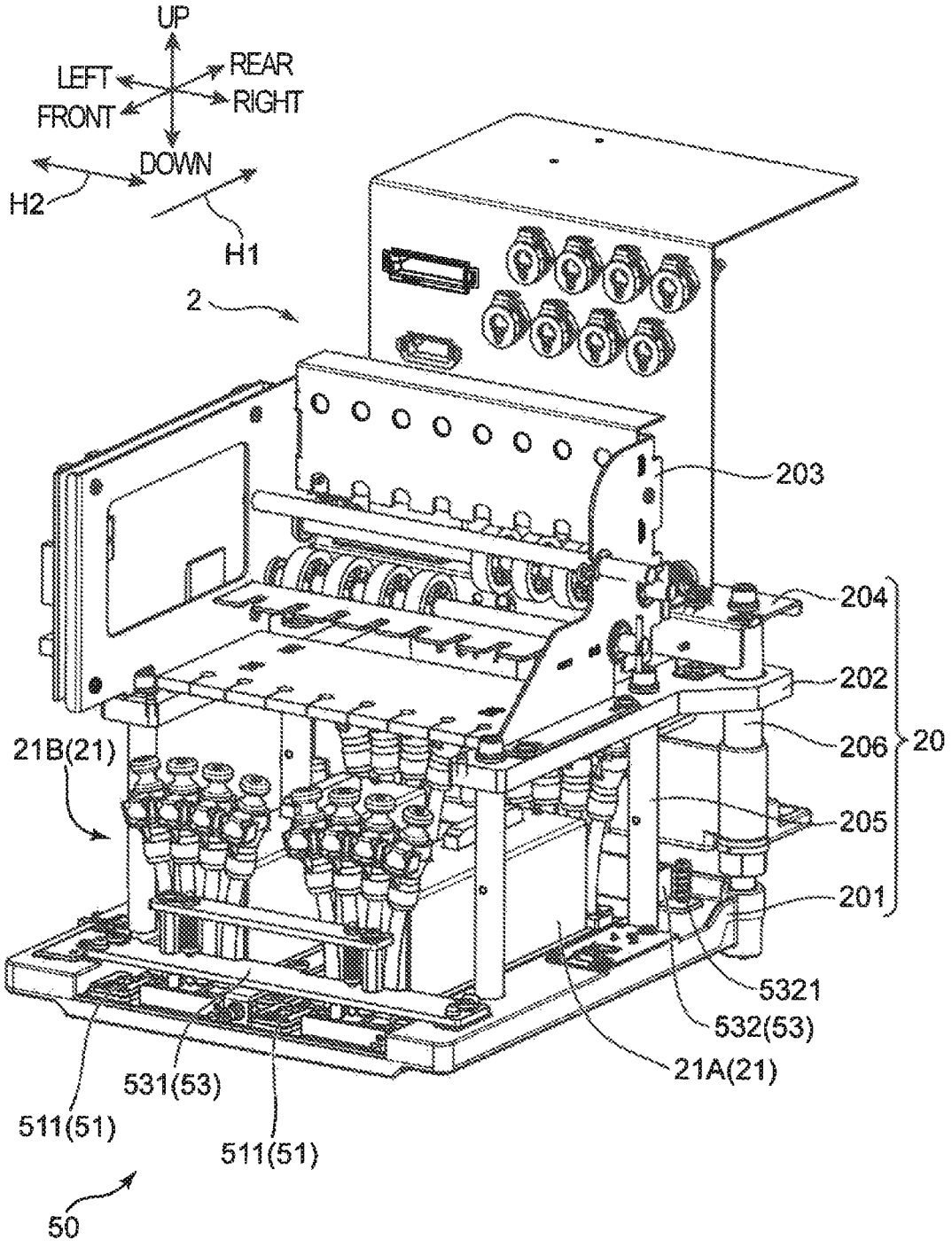
FIG. 23 is a perspective view of the carriage in a state where the head unit mounted on the lower frame is positioned by a third positioning part of the fixing mechanism.
Figure 24:
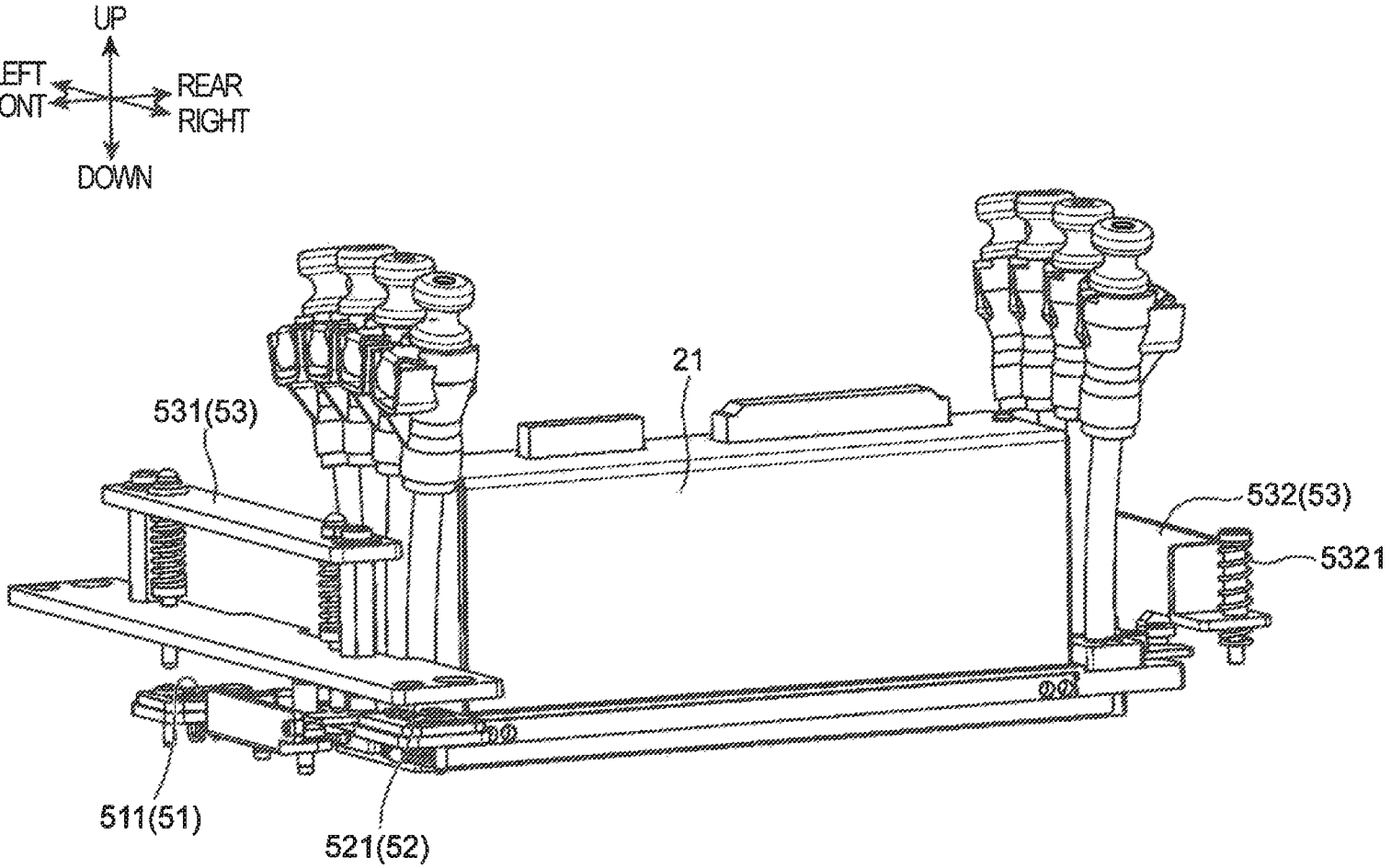
FIG. 24 is a perspective view illustrating a state where the head unit mounted on the lower frame is positioned by the third positioning part of the fixing mechanism.

FIGS. 18 and 19 are perspective views of the carriage 2 while a first operation is being performed when mounting the head unit 21 to the lower frame 201. FIG. 20 is a perspective view of the carriage 2 in a state where the head unit 21 is mounted on the lower frame 201 after a second operation when mounting the head unit 21 to the lower frame 201. FIGS. 21 and 22 are perspective views illustrating a state where the head unit 21 is positioned and fixed by the fixing mechanism 50 in the state where it is mounted on the lower frame 201. FIG. 23 is a perspective view of the carriage 2 in a state where the head unit 21 mounted on the lower frame 201 is positioned by the third pressing member 531 of the third positioning part 53. FIG. 24 is a perspective view illustrating a state where the head unit 21 mounted on the lower frame 201 is positioned by the third pressing member 531 of the third positioning part 53.

The head unit 21 is mounted to the lower frame 201 by the first operation and the second operation performed by a worker. The first operation is an operation performed by a worker when mounting the head unit 21 to the lower frame 201, and is an operation of moving the head unit 21 in the mounting direction H1 in an inclined posture, in which the downstream end part in the mounting direction H1 of the head unit 21 abuts the lower frame 201 while the upstream end part in the mounting direction H1 is apart upward from the lower frame 201 (see FIGS. 18 and 19). The second operation is an operation performed by a worker following the first operation, and is an operation of pressing the upstream end part in the mounting direction H1 of the head unit 21 after moving in the mounting direction H1, downward toward the lower frame 201 (see FIG. 20).

As illustrated in FIGS. 18 and 19, when mounting the head unit 21 to the lower frame 201, while the first operation is being performed to move the head unit 21 in the mounting direction H1 to the lower frame 201, each of the first pressing member 511 and the second pressing member 521 is in the second posture in which the pressing force to the head unit 21 is released. In this way, in the first operation when mounting the head unit 21 to the lower frame 201, the head unit 21 can be prevented from receiving frictional resistance from each of the pressing members 511 and 521, and hence workability in the first operation can be improved.

In addition, as illustrated in FIG. 20, when the second operation is performed in a state where lower end edge of the front end part to be one end part in the longitudinal direction of the head unit 21 abuts the protrusion 5213, each of the first pressing member 511 and the second pressing member 521 rotates downward about the shaft part 5111 or 5211. In this way, each of the first pressing member 511 and the second pressing member 521 changes its posture from the second posture to the first posture, and rocks in the first posture in the direction of pressing the head unit 21, so that it can presses the head unit 21 with an appropriate pressing force.

In addition, as described above, each of the first pressing member 511 and the second pressing member 521 is disposed at the upstream end part in the mounting direction H1 in the lower frame 201 (the front end part). In this way, in the first operation when mounting the head unit 21 to the lower frame 201, the first pressing member 511 and the second pressing member 521 do not interfere with movement of the head unit 21 when the head unit 21 is moved in the mounting direction H1. Therefore, workability in the first operation is improved.

In addition, in the first position regulation part 512 of the first positioning part 51, the first engagement part 5121 and the second engagement part 5122 are engaged with each other by performing the first operation when mounting the head unit 21 to the lower frame 201. Further, each of the first pressing member 511 and the second pressing member 521 rotates about the shaft part 5111 or 5211, so as to change its posture from the second posture to the first posture, by performing the second operation is performed to the head unit 21 in the state where the first engagement part 5121 and the second engagement part 5122 are engaged with each other. When the second operation is performed after the first operation, as the first engagement part 5121 and the second engagement part 5122 are engaged with each other, the second operation can be performed to press downward the upstream end part in the mounting direction H1 of the head unit 21 with the fulcrum of the engagement part of the first engagement part 5121 and the second engagement part 5122. Further, this second operation enables the first pressing member 511 and the second pressing member 521 to change their postures from the second posture to the first posture of pressing the head unit 21.

In addition, as illustrated in FIGS. 9 and 18, the lower frame 201 includes a guide section 2011 disposed in a peripheral part of the opening 201A so as to extend along the mounting direction H1 of the head unit 21. The guide section 2011 guides movement of the head unit 21 in the mounting direction H1 in the first operation when mounting the head unit 21 to the lower frame 201. In this way, workability in the first operation is improved.

What is claimed is:

1. A liquid processing device comprising:

a head unit configured to eject liquid to a predetermined work, the head unit having an ink election surface;

a head holder including a mounting part on which the head unit is mounted, so as to hold the head unit in a state mounted on the mounting part; and a fixing mechanism configured to position and fix the head unit moved in a predetermined mounting direction and mounted to the mounting part, with respect to the mounting part such that the head unit is parallel to the ink election surface; wherein the fixing mechanism includes a first positioning part including a first pressing member that presses a first part of the head unit mounted on the mounting part in the mounting direction, and a first position regulation part that regulates position of the head unit pressed by the first pressing member in the mounting direction on the mounting part, and a second positioning part including a second pressing member that presses a second part, different from the first part, of the head unit mounted on the mounting part to one side in a head unit width direction parallel to the ink election surface and perpendicular to the mounting direction, and a second position regulation part that regulates position of the head unit pressed by the second pressing member in the width direction on the mounting part, and each of the first pressing member and the second pressing member is rotatable about a predetermined axis so as to be capable of changing its posture between a first posture and a second posture inclined upward at its end from the first posture, and is disposed on the mounting part in a rockable manner in a direction pressing the head unit, so as to press the head unit in the first posture.

2. The liquid processing device according to claim 1, wherein the head unit contacts with the mounting part at a downstream end part in the mounting direction, and is mounted to the mounting part by a first operation of moving in the mounting direction in an inclined posture in which an upstream end part in the mounting direction is apart upward from the mounting part, and by a second operation of pressing downward the upstream end part in the mounting direction toward the mounting part, and each of the first pressing member and the second pressing member is in the second posture while the first operation is being performed when mounting the head unit to the mounting part, changes its posture from the second posture to the first posture when the second operation is performed, and presses the head unit in the first posture.

3. The liquid processing device according to claim 2, wherein the first position regulation part includes a first engagement part disposed at the downstream end part in the mounting direction of the head unit, and a second engagement part that is disposed at the mounting part and is capable of engaging with the first engagement part, and the second position regulation part includes a third engagement part disposed at the upstream end part in the mounting direction of the head unit, and a fourth engagement part that is disposed at the mounting part and is capable of engaging with the third engagement part.

4. The liquid processing device according to claim 2, wherein each of the first pressing member and the second pressing member is disposed at the upstream end part in the mounting direction on the mounting part.

5. The liquid processing device according to claim 3, wherein the first engagement part and the second engagement part are engaged with each other by performing the first operation when mounting the head unit to the mounting part, and each of the first pressing member and the second pressing member rotates about the predetermined axis so as to change its posture from the second posture to the first posture, by performing the second operation to the head unit in the state where the first engagement part and the second engagement part are engaged with each other.

6. The liquid processing device according to claim 2, wherein the mounting part includes a guide section disposed to extend in the mounting direction so as to guide movement of the head unit in the mounting direction in the first operation when mounting the head unit to the mounting part.

* * * * *